US011297892B2

(12) United States Patent
Hill

(10) Patent No.: US 11,297,892 B2
(45) Date of Patent: Apr. 12, 2022

(54) ASSISTIVE DEVICES FOR APPLYING AND REMOVING PROTECTIVE SHOE COVERS, AND RELATED SYSTEMS AND PROTECTIVE COVERS

(71) Applicant: Scott D. Hill, Hamilton, OH (US)

(72) Inventor: Scott D. Hill, Hamilton, OH (US)

( * ) Notice: Subject to any disclaimer, the term of this patent is extended or adjusted under 35 U.S.C. 154(b) by 210 days.

(21) Appl. No.: 15/214,742

(22) Filed: Jul. 20, 2016

(65) Prior Publication Data

US 2017/0020225 A1 Jan. 26, 2017

Related U.S. Application Data

(60) Provisional application No. 62/196,077, filed on Jul. 23, 2015.

(51) Int. Cl.
*A47G 25/80* (2006.01)
*A47G 25/90* (2006.01)
(Continued)

(52) U.S. Cl.
CPC ..... *A43B 3/16* (2013.01); *A43B 3/18* (2013.01); *A47G 25/80* (2013.01); *A47G 25/907* (2013.01);
(Continued)

(58) Field of Classification Search
CPC ..... A43B 3/18; A43B 3/106; A43B 3/22; A43B 3/26; B65D 83/08; B65D 83/0817;
(Continued)

(56) References Cited

U.S. PATENT DOCUMENTS 1,178,109 A * 4/1916 Staubly ..... A47G 25/80 223/114
3,775,793 A * 12/1973 Casavant ..... A43B 3/163 12/1 R (Continued)

OTHER PUBLICATIONS shoecovermedicalprotector.com; Internet Webpage entitled "Automatic Shoe Cover Manual Dispenser" visited Mar. 16, 2015; 3 pages.

(Continued)

*Primary Examiner* — Katharine G Kane
(74) *Attorney, Agent, or Firm* — Wood Herron & Evans LLP

(57) ABSTRACT

An assistive device for applying and removing a protective shoe cover from a shoe of a user includes a base, a shoe cover application mechanism supported by the base and configured to releasably receive and retain a protective shoe cover in an expanded state for applying the expanded protective shoe cover to a shoe, and a shoe cover removal mechanism supported by the base and configured to releasably grip a portion of a protective shoe cover fitted on a shoe for removing the protective shoe cover from the shoe. The assistive device may be stored in a device holder mountable to a vertical support surface. A protective shoe cover includes a non-rigid body, an elastic portion, and at least one device engagement element on the non-rigid body and configured to releasably engage an assistive device for at least one of applying the protective shoe cover to a shoe or removing the protective shoe cover from a shoe.

13 Claims, 15 Drawing Sheets

(51) Int. Cl.
*A43B 3/16* (2022.01)
*B65D 83/08* (2006.01)
*A43B 3/18* (2022.01)

(52) U.S. Cl.
CPC ..... *A47G 25/908* (2013.01); *B65D 83/08* (2013.01); *B65D 83/0817* (2013.01); *B65D 83/0894* (2013.01)

(58) Field of Classification Search
CPC ..... B65D 83/0894; A47G 25/908; A47G 25/907; A47G 25/80
See application file for complete search history.

(56) References Cited

U.S. PATENT DOCUMENTS 3,903,620 A * 9/1975 Gillet ..... A43C 13/12 2/114
5,228,215 A * 7/1993 Bayer ..... A43B 3/18 36/7.4
5,687,889 A * 11/1997 Liden ..... A47G 25/80 223/111
6,044,578 A * 4/2000 Kelz ..... A43B 3/18 36/117.4
6,543,075 B2 * 4/2003 Gultekin ..... A43D 11/003 12/1 R
7,440,816 B1 * 10/2008 He ..... A43B 3/16 221/13
7,448,521 B2 * 11/2008 Hu ..... A43B 3/163 12/1 R
7,559,159 B1 * 7/2009 Lundberg ..... A43B 3/163 36/7.1 R
7,669,351 B1 * 3/2010 Ghotbi ..... A43B 3/163 12/1 R
8,789,297 B1 * 7/2014 Doyle ..... A43B 5/005 36/130
9,210,968 B2 * 12/2015 Lanchulev ..... A43D 25/06
9,215,910 B2 * 12/2015 Dhillon ..... A43D 11/003
10,040,620 B1 * 8/2018 Hudson ..... B65D 83/08
2002/0020031 A1 * 2/2002 Gultekin ..... A43D 11/003 12/1 R
2003/0190442 A1 * 10/2003 Campbell ..... A43B 3/16 428/35.2
2007/0163912 A1 * 7/2007 Chen ..... A43B 3/16 206/477
2008/0000035 A1 * 1/2008 Levine ..... A43B 3/16 12/1 R
2008/0040889 A1 * 2/2008 Edwards ..... A43B 3/163 16/42 R
2008/0237277 A1 * 10/2008 Xu ..... B65H 1/00 222/526
2009/0071989 A1 * 3/2009 He ..... A43B 3/16 223/111
2009/0152312 A1 * 6/2009 Li ..... A43B 3/16 223/113
2009/0288314 A1 * 11/2009 Kay ..... A43B 5/185 36/91
2010/0288800 A1 * 11/2010 Xu ..... A43B 3/106 223/113
2011/0272440 A1 * 11/2011 Heller ..... A47G 25/907 223/113
2014/0353326 A1 * 12/2014 Shi ..... A47G 25/907 221/1
2015/0272365 A1 * 10/2015 Heller ..... A43B 3/163 223/113
2016/0107824 A1 * 4/2016 Xu ..... A43D 999/00 221/56
2017/0020225 A1 * 1/2017 Hill ..... A43B 3/16
2017/0088339 A1 * 3/2017 Xu ..... B65D 83/0894
2018/0271206 A1 * 9/2018 Corbett ..... A43B 3/16

OTHER PUBLICATIONS

Southwest Solutions Group; Brochure entitled The Ultimate Hands-Free Shoe Cover Dispensers; obtained from http://c3.southwestsolutions.com/public_pdf/ShoeCoverDispensers_SSG0614.pdf; visited Mar. 11, 2015; 3 pages.
Southwest Solutions Group; Brochure entitled "Shoe Cover Comparison"; obtained from http://c3.southwestsolutions.com/public_pdf/ShoeCoverComparison_SSG614 pdf; visted Mar. 16, 2015; 1 page.
Southwest Solutions Group; Brochure entitled "Dispenser Distinctives"; obtained from http://c3.southwestsolutions.com/public_pdf/DispenserDistinctives_SSG614.pdf; visited Mar. 16, 2015;1 page.

* cited by examiner

ASSISTIVE DEVICES FOR APPLYING AND REMOVING PROTECTIVE SHOE COVERS, AND RELATED SYSTEMS AND PROTECTIVE COVERS

CROSS-REFERENCE TO RELATED APPLICATION

This application claims the filing benefit of U.S. Provisional Application Ser. No. 62/196,077 filed Jul. 23, 2015, the disclosure of which is hereby incorporated by reference herein in its entirety.

TECHNICAL

The present invention relates generally to wearable articles and, more particularly, to devices and systems for applying and removing protective shoe covers.

BACKGROUND

Disposable protective shoe covers, often referred to as "booties," are worn by professionals for preventing contaminants on one's shoes from contaminating a floor surface in which a professional is maneuvering. Disposable protective shoe covers are often used in various service industries and medical facilities. For example, a service professional in the HVAC industry may apply a shoe cover to each one of his or her shoes prior to walking through the residence of a customer. A medical professional in a medical facility may apply a shoe cover to each one of his or her shoes before entering certain areas of the medical facility, such as an operating room. After performing the necessary services, the professional may then remove the shoe covers from his or her shoes upon leaving the area in which contamination is to be prevented, and then discard the shoe covers or save them for reuse.

Known devices for dispensing and applying disposable protective shoe covers include bulky, automated machines having various moving mechanical components and which may have limited mobility due to their size, weight, and physical configuration. Such devices thus are generally unsuitable for use in service industries in which a service professional may have to carry various items between his or her service vehicle and a customer residence.

Additionally, applying protective shoe covers to one's shoes while in a standing position, and without the use of an assistive device, can be very difficult to perform with or without full, unencumbered use of both hands for applying a shoe cover while simultaneously maintaining body balance. Furthermore, service professionals are often carrying various tools and other items upon entering a customer residence. Because their hands are occupied with carrying various items, shoe cover application is made quite difficult to perform in the customer residence without dropping the items onto the residence floor, or otherwise sitting on the floor, which may risk contamination and be considered generally unprofessional. Consequently, service professionals sometimes elect to apply shoe covers while at their parked service vehicle, before entering the customer residence. However, the applied shoe covers may become contaminated as the service professional walks from the parked vehicle to the residence, which then risks contamination of the customer residence upon entry. Thus, the purpose of applying the protective shoe covers in the first place is substantially defeated.

Accordingly, there is a need for an improved device for assisting the application of disposable protective shoe covers to one's shoes, which device addresses the challenges and shortcomings described above.

SUMMARY

According to an exemplary embodiment of the invention, an assistive device for applying and removing a protective shoe cover from a shoe of a user includes a base, a shoe cover application mechanism supported by the base, and a shoe cover removal mechanism supported by the base. The shoe cover application mechanism is configured to releasably receive and retain a protective shoe cover in an expanded state for applying the expanded protective shoe cover to a shoe, and the shoe cover removal mechanism is configured to releasably grip a portion of a protective shoe cover fitted on a shoe for removing the protective shoe cover from the shoe.

According to another exemplary embodiment of the invention, a system for use with protective shoe covers includes an assistive device and a device holder. The assistive device includes at least one of a shoe cover application mechanism configured to releasably receive and retain a protective shoe cover in an expanded state for applying the expanded protective shoe cover to a shoe, or a shoe cover removal mechanism configured to releasably grip a portion of a protective shoe cover fitted on a shoe for removing the protective shoe cover from the shoe. The device holder is configured to releasably receive and retain the assistive device when the assistive device is not in use, and is mountable to a vertical support surface.

According to another exemplary embodiment of the invention, a protective shoe cover configured to cover a shoe of a user includes a non-rigid body, an elastic portion, and at least one device engagement element. The non-rigid body defines an inner pocket configured to receive a shoe. The elastic portion is formed at an upper end of the non-rigid body and defines an opening to the inner pocket. The elastic portion being alterable between an expanded state in which the elastic portion expands to receive the shoe through the opening and into the inner pocket, and a contracted state in which the elastic portion contracts to conform to an outer surface of the shoe located within the inner pocket. The at least one device engagement element is provided on the non-rigid body and is configured to releasably engage an assistive device for at least one of applying the protective shoe cover to a shoe or removing the protective shoe cover from a shoe.

Various additional features and advantages of the invention will become more apparent to those of ordinary skill in the art upon review of the following detailed description of exemplary embodiments taken in conjunction with the accompanying drawings. The drawings, which are incorporated in and constitute a part of this specification, illustrate exemplary embodiments of the invention and, together with the general description given above and the detailed description given below, serve to explain the exemplary embodiments.

BRIEF DESCRIPTION OF THE DRAWINGS

Like reference numerals are used to indicate like features throughout the various figures, wherein.

DETAILED DESCRIPTION

Figure 1:
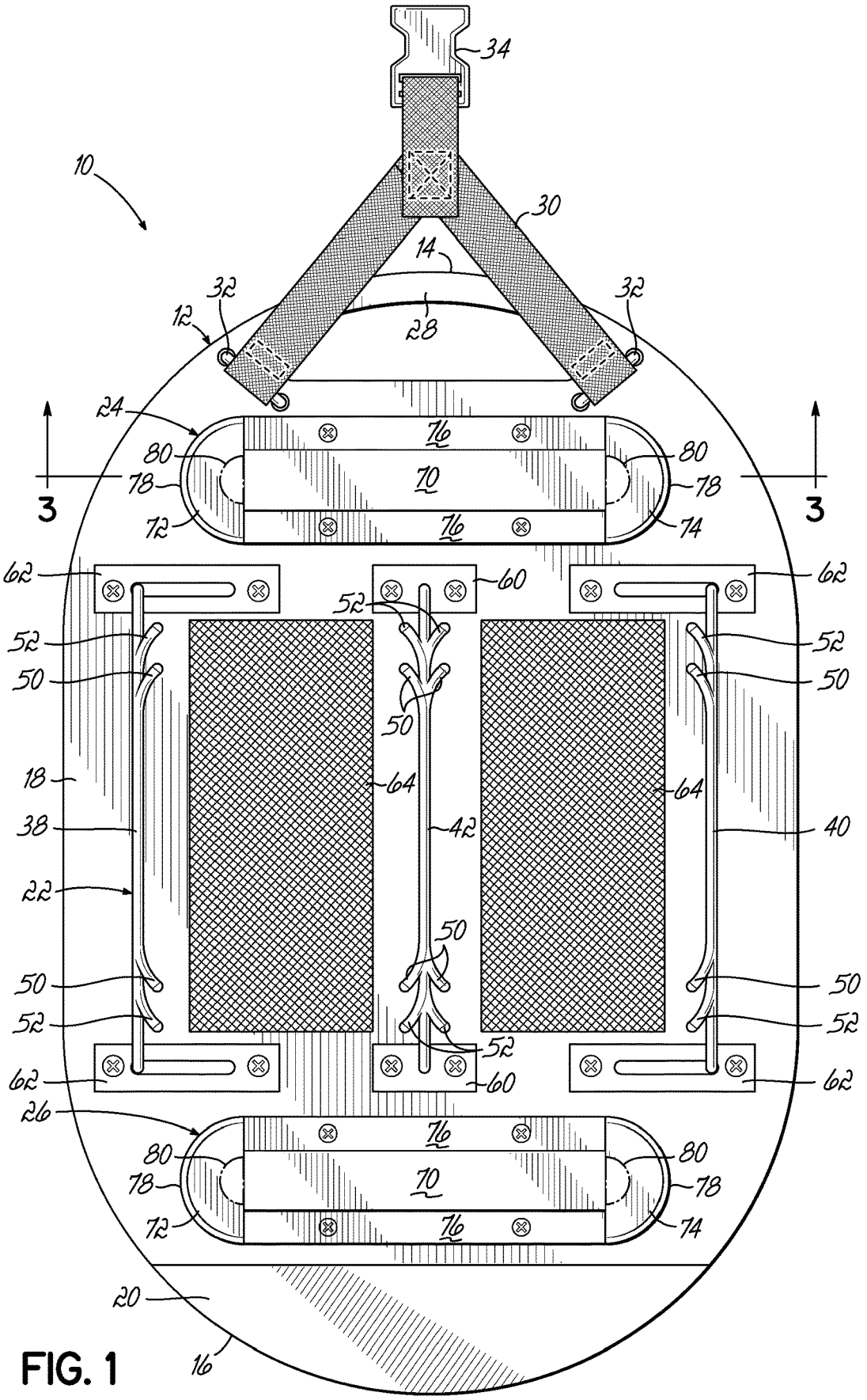
FIG. 1 is a top view of a shoe cover assistive device according to an exemplary embodiment of the invention, having shoe cover application and removal mechanisms for applying and removing protective shoe covers.

Referring to FIGS. 1-4, an exemplary embodiment of an assistive device 10 for applying and removing protective shoe covers ("booties") from the shoes of a user is shown. The assistive device 10 generally includes a base 12 having a first end 14, an opposed second end 16, a deck portion 18, and a tail portion 20. The deck portion 18 may be generally planar, and supports a shoe cover application mechanism 22 and first and second shoe cover removal mechanisms 24, 26. The tail portion 20 extends from the deck portion 18 at the second end 16 of the base 12 and is angled upwardly relative to the deck portion 18 so as to define a "kick-tail" like feature, as shown best in FIGS. 2 and 15. As described below in connection with FIG. 15, the tail portion 20 facilitates easy retrieval of the assistive device 10 from a ground surface on which the device 10 has been positioned. The shoe cover application mechanism 22 and the shoe cover removal mechanisms 24, 26 may be used in combination with any types of protective shoe covers commercially available, or with the new protective shoe covers 200, 220, 230 described below in connection with FIGS. 16-18.

Figure 12:
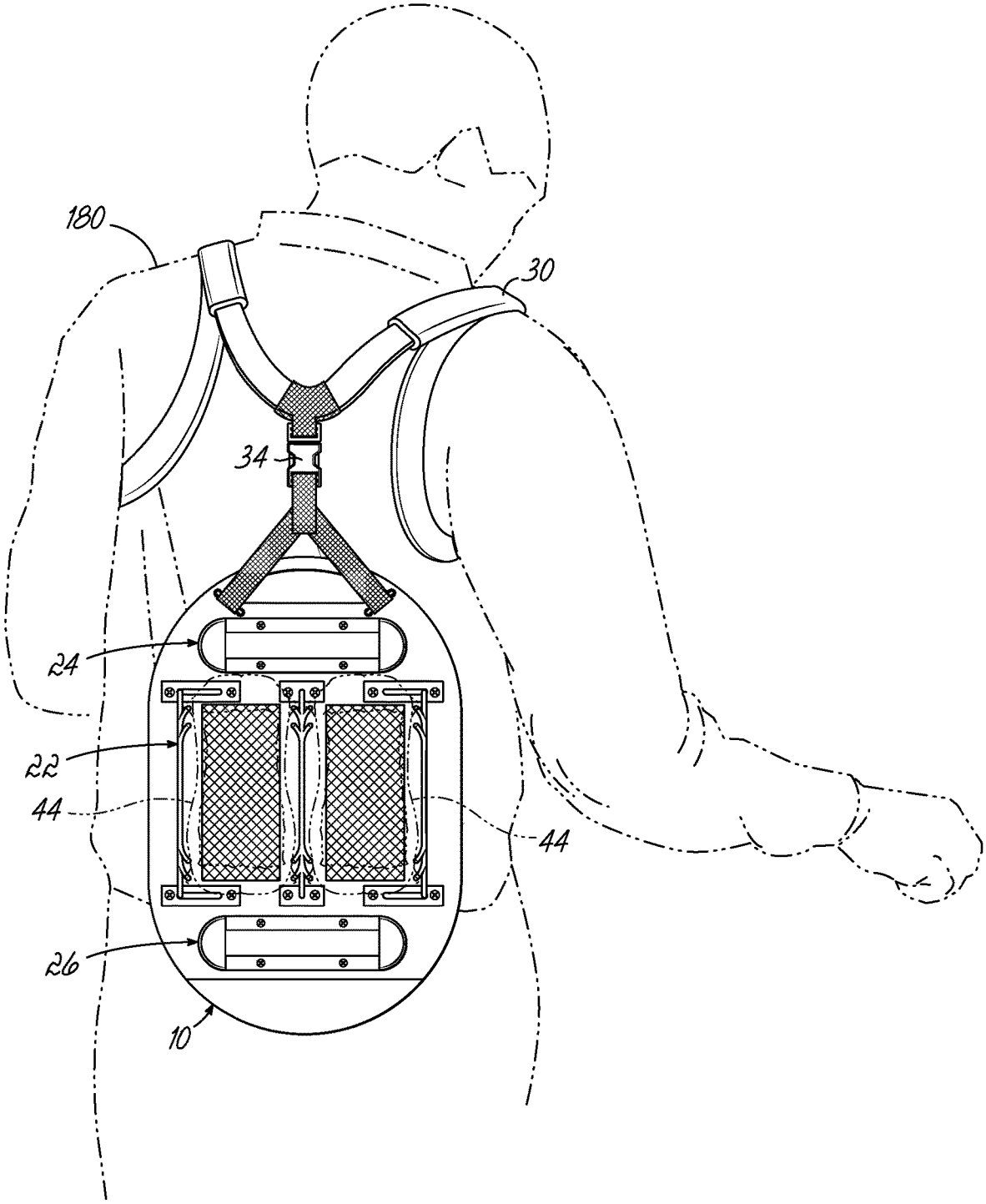
FIG. 12 is an elevation view showing the assistive device of FIG. 1 being transported by a user according to an exemplary embodiment.

In exemplary embodiments, the base 12 may be formed with any size and shape suitable for portable use, such as the oval-like, rounded-rectangular shape shown in FIG. 1. The first end 14 of the base 12 may include a handle 28 which may be grasped by the hand of a user. The first end 14 may also include a support strap 30 secured to the base 12 at one or more mounting rings 32, for example. The support strap 30 may be generally Y-shaped, as shown, or may be formed with any other suitable configuration. The support strap 30 may include one or more buckles 34 or other releasable fastener for releasably attaching to a second strap portion, as shown in FIG. 12, which may be a shoulder strap or a back strap, for example, that is wearable by the user. The support strap 30 may further include an integrated handle element which may be gripped by the user for carrying separate from the handle 28. It will be appreciated that various alternative configurations of carrying straps for use with the assistive device 10 are also possible.

Figure 2:
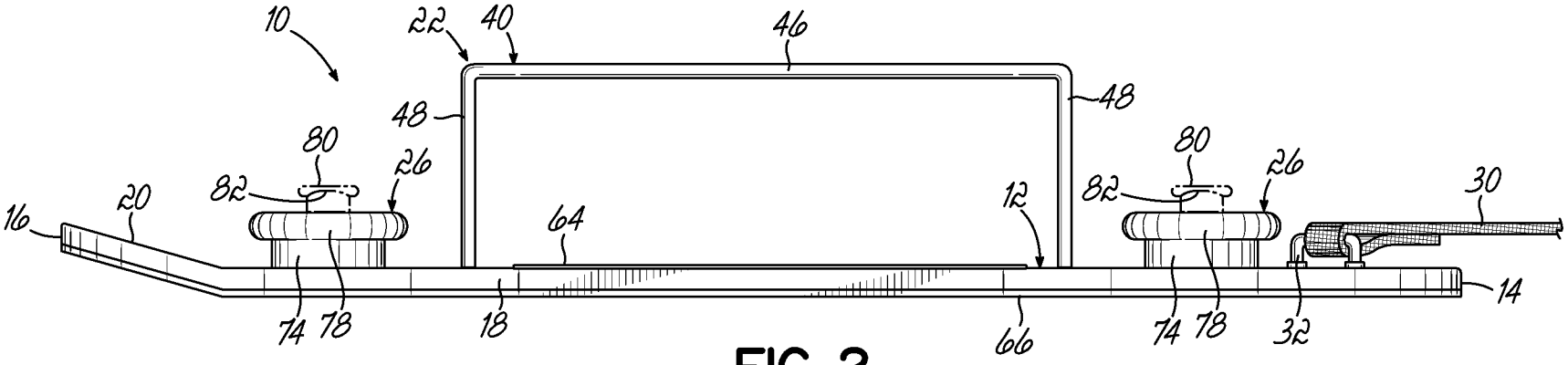
FIG. 2 is a side view of the shoe cover assistive device of FIG. 1.
Figure 4:
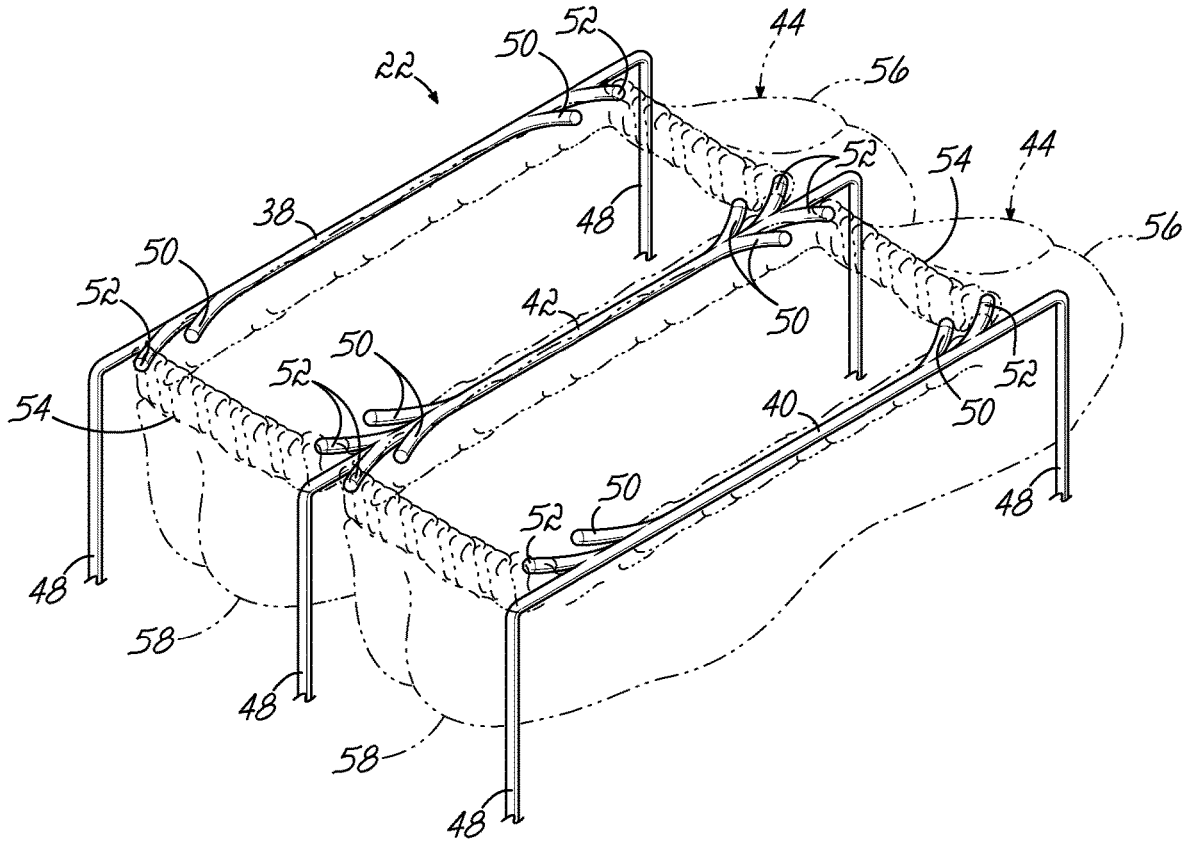
FIG. 4 is a perspective view of the shoe cover application mechanism of FIG. 1, loaded with a pair of protective shoe covers.

Referring to FIGS. 1, 2, and 4, in one embodiment the shoe cover application mechanism 22 is secured to the deck portion 18 of the base 12 and includes a first side shoe cover mount 38, a second side shoe cover mount 40, and a middle shoe cover mount 42 disposed therebetween. The mounts 38, 40, 42 may be arranged generally parallel to one another and spaced apart so as to define a first shoe cover channel between the first side mount 38 and the middle mount 42, and a second shoe cover channel between the second side mount 40 and the middle mount 42. As shown best in FIG. 4, the first and second shoe cover channels may receive respective first and second protective shoe covers 44 in expanded states. The protective shoe covers 44 are shown in generic form and may any type of protective shoe covers commercially available, or the shoe covers 200, 220, 230 described below in connection with FIGS. 16-18.

As shown in the Figures, in exemplary embodiments each of the shoe cover mounts 38, 40, 42 may be in the form of an elongate rail that is secured to the deck portion 18 and formed with a generally rectangular shape that projects perpendicularly outward relative to the deck portion 18. For example, as shown, each mount 38, 40, 42 may be include an upper leg 46 extending substantially parallel to the deck portion 18, and two opposed lower legs 48 depending perpendicularly downward from the upper leg 46 at respective first and second ends thereof.

Each of the shoe cover mounts 38, 40, 42 includes a plurality of shoe cover retainers, shown in the form of prongs 50, 52, to which a respective portion of a disposable shoe cover 44 may be mounted for supporting the shoe cover in an expanded state for receiving a shoe, or foot, of a user. In particular, the first and second side mounts 38, 40 each includes first and second inner prongs 50 provided at respective first and second ends of the side mounts 38, 40, and first and second outer prongs 52 provided at respective first and second ends of the side mounts 38, 40. The middle mount 42 includes inner and outer prongs 50, 52 projecting from opposed first and second lateral sides thereof. In particular, a first set of first and second inner prongs 50 and a first set of first and second outer prongs 52 projects from a first side of the middle mount 42. A second set of first and second inner prongs 50 and a second set of first and second outer prongs 52 projects from a second side of the middle mount 42.

As shown in the illustrated exemplary embodiment, each prong 50, 52 may project angularly outward from its respective mount 38, 40, 42 in a direction toward the respective end of the mount 38, 40, 42 at which the prong 50, 52 is disposed. Additionally, the prongs 50, 52 of the first and second side mounts 38, 40 may project inwardly toward the middle mount 42, and the prongs 50, 52 of the middle mount 42 may project outwardly toward the first and second side mounts 38, 40. Various alternative quantities and configurations of prongs may be provided on the shoe cover mounts 38, 40, 42.

In one embodiment, each shoe cover mount 38, 40, 42 may be an integral rail-like element formed via a metal bending, stamping, or casting process. In another embodiment, each shoe cover mount 38, 40, 42 may be comprised of a plurality of bar members arranged side by side and welded together. For example, a first bar element may be provided with a rectangular shape as generally seen in FIGS. 2 and 4. A second bar element bar element being substantially linear and having outwardly bent ends may be welded to the first bar element to define the first and second outer prongs 52. A third bar element being substantially linear and having outwardly bent ends may be welded to the first bar element and/or the second bar element to define the first and second inner prongs 50.

While the shoe cover application mechanism 22 includes shoe cover mounts 38, 40, 42 in the form of rectangular shaped rails having prongs 50, 52, it will be appreciated that various alternative configurations of shoe cover application mechanisms may be provided. For example, the shoe cover mounts 38, 40, 42 may be formed with various alternative shapes suitable for receiving shoe covers and shoes therebetween, and may include any suitable quantity, arrangement, and shape of prongs or other shoe cover retainers. In that regard, the prongs 50, 52 may be substituted with various alternative features or mechanisms suitable for releasably securing a protective shoe cover to the shoe cover mounts 38, 40, 42 or comparable structure.

As best shown in FIG. 4, in an exemplary embodiment, a first protective shoe cover 44 may be mounted to the outer prongs 52 of the first side mount 38 and to the outer prongs 52 of the first lateral side of the middle mount 42. A second protective shoe cover 44 may be mounted to the outer prongs 52 of the second side mount 40 and of the second lateral side of the middle mount 42. Alternatively, the shoe covers 44 may be mounted to the inner prongs 50 of the mounts 38, 40, 42, or to any suitable combination of inner and outer prongs 50, 52, for example to accommodate any size shoe cover 44 and any size shoe of a user.

Each of the first and second inner prongs 50 and the first and second outer prongs 52 on any one mount 38, 40, 42 are spaced apart from one another with a distance sufficient to maintain an elastic collar 54 of the respective shoe cover 44 mounted thereon in an expanded state in which a shoe (not shown) of a user may be inserted into the shoe cover 44 for application. Once the shoe has been inserted into the shoe cover 44, the user may kick his or her foot slightly forward to disengage a toe end 56 of the shoe cover 44 from the shoe cover mounts 38, 40, 42, and then slightly backward to disengage a heel end 58 of the shoe cover 44 from the shoe cover mounts 38, 40, 42. Alternatively, the user may disengage the heel end 58 and then the toe end 56 of the shoe cover 44. In this manner, the protective shoe cover 44 is easily disengaged from the assistive device 10 and the elastic collar 54 may snap into a contracted state in which it closely conforms to the outer surface of the shoe and/or the foot of the user, such that the shoe cover 44 is effectively applied to the shoe of the user.

The middle shoe cover mount 42 may be rigidly secured to the deck portion 18 of the base 12 with rigid base plates 60. In contrast, the first and second side shoe cover mounts 38, 40 may be movably coupled to the deck portion 18 with adjustable base plates 62 that enable selective adjustment of the side mounts 38, 40 in lateral directions relative to the deck portion 18 and the middle mount 42, as best shown in FIG. 1. For example, each of the adjustable base plates 62 may include a laterally extending slot in which the lower ends of the lower legs 48 of the respective side mount 38, 40 are received and are slidable relative to the base 12. Each of the side mounts 38, 40 may be moved closer toward or further away from the middle mount 42 so as to define a shoe cover channel therebetween having any suitable width, for receiving shoes of various widths for example. Once provided in the desired position relative to the middle mount 42, the side mount 38, 40 may be secured in place using any suitable mechanical fastener, such as a threaded thumb screw or a clamping mechanism for example. In another embodiment, the middle mount 42 may also be laterally adjustable.

Referring to FIGS. 1 and 2, one or more non-slip traction pads 64 may be positioned on the deck portion 18 of the base 12 between, or otherwise proximate to, each pair of adjacent shoe cover mounts 38, 40, 42. The non-slip traction pads 64 provide a surface on which a user may safely rest one of his or her feet, with or without an applied protective shoe cover, while applying or removing a protective shoe cover to the other foot. The non-slip traction pad 64 increases friction between the foot of the user and the assistive device 10, and thereby substantially decreases the risk of unintentional slippage between the foot and the assistive device 10, for example during shoe cover application or removal, described below. It will be appreciated that the deck portion 18 may include any suitable quantity of traction pads 64, positioned at any suitable location on the deck portion 18 and having any suitable area. For example, the deck portion 18 may include a single traction pad 64 that extends across a full width of the deck portion 18, including the outer edges of the deck portion 18.

The base 12 of the assistive device 10 may be formed of any suitably rigid yet lightweight material, such as aluminum or various polymeric materials, for example. As best shown in FIG. 2, a bottom surface of the base 12 may be covered with a protective layer 66 for preventing damage to the ground surface on which the assistive device 10 is placed during use. The protective layer 66 may be formed of a rubber, for example, or any other suitable non-abrasive material. The protective layer 66 may be releasably or permanently attached to the base 12.

Figure 5:
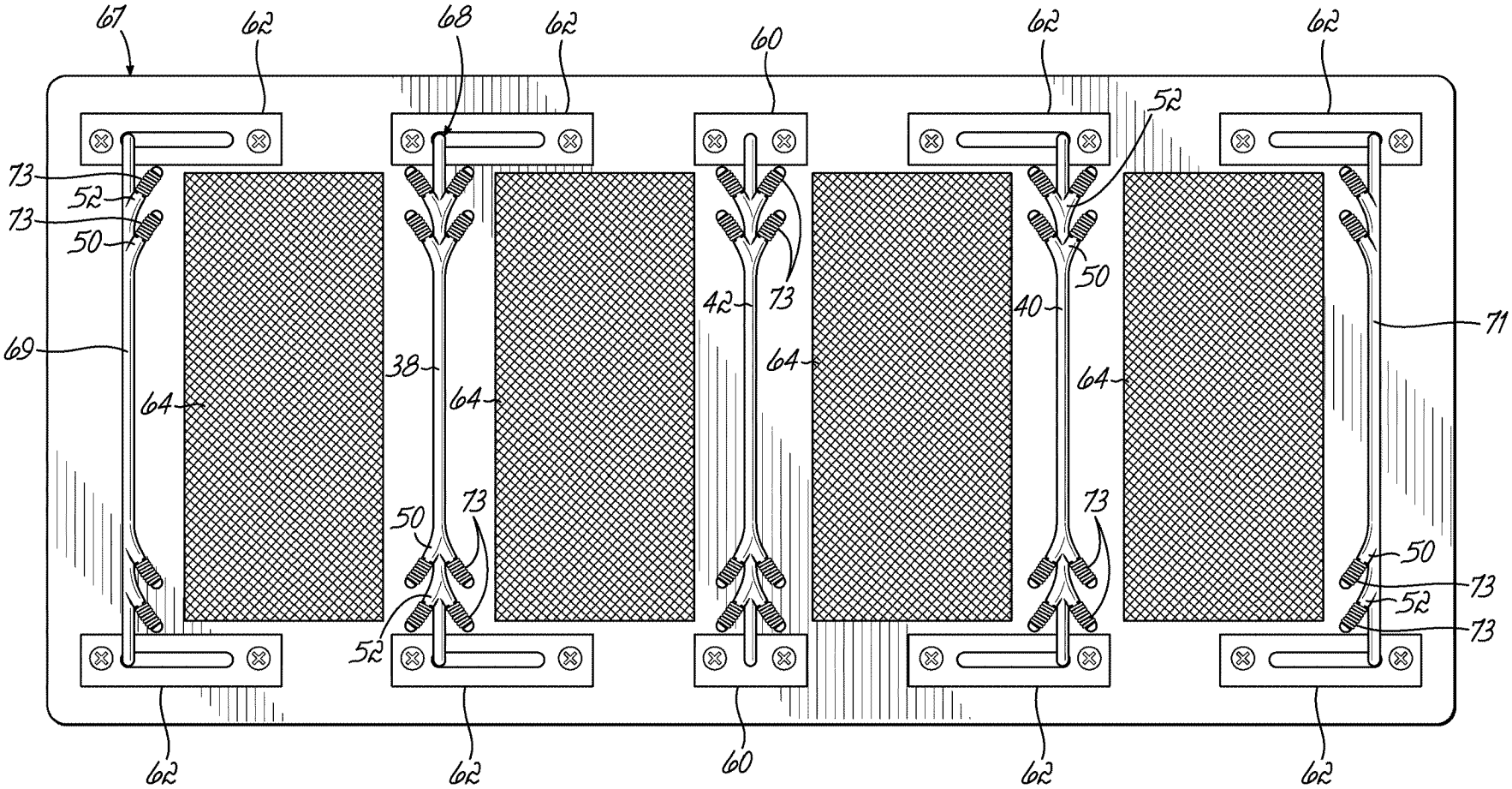
FIG. 5 is a top view of a shoe cover application mechanism according to another exemplary embodiment.

Referring to FIG. 5, a deck portion 67 and shoe cover application mechanism 68 according to an exemplary alternative embodiment of the invention are shown, where similar reference numerals refer to similar features described above. It will be appreciated that FIG. 5 shows only the section of the deck portion 67 that supports the application mechanism 68. The shoe cover application mechanism 68, and the supporting section of the deck portion 67, are formed with a double width relative to the configuration shown in FIG. 1. In that regard, the shoe cover application mechanism 68 includes a first auxiliary shoe cover mount 69 positioned adjacent to and laterally outward of the first side shoe cover mount 38, and a second auxiliary shoe cover mount 71 positioned adjacent to and laterally outward of the second side shoe cover mount 40. The first auxiliary shoe cover mount 69 and first side shoe cover mount 38 define a third shoe cover channel therebetween and cooperate to support a third protective shoe cover in an expanded state. Similarly, the second auxiliary shoe cover mount 71 and second side shoe cover mount 40 define a fourth shoe cover channel therebetween and cooperate to support a fourth protective shoe cover in an expanded state. In exemplary embodiments, two of the shoe cover channels may be loaded with a first type of protective shoe covers, and the other two of the shoe cover channels may be loaded with a second type of protective shoe covers. Such protective shoe covers may include indoor-type and outdoor-type protective shoe covers, for example, as described below.

Each of the auxiliary shoe cover mounts 69, 71 may include a set of inner prongs 50 and a set of outer prongs 52 projecting laterally outward toward the respective first or second side shoe cover mount 38, 40. Further, in this embodiment, the first and second side shoe cover mounts 38, 40 may include an additional set of inner prongs 50 and an additional set of outer prongs 52 projecting laterally outward toward the respective first or second auxiliary shoe cover mount 69, 71. As shown, each of the side and auxiliary shoe cover mounts 38, 40, 69, 71 may be laterally adjustable relative to the deck portion 67 via adjustable base plates 62.

Still referring to FIG. 5, one or more of the inner and outer prongs 50, 52 of shoe cover application mechanism 68, or of any of the other shoe cover application mechanisms disclosed herein, may include a spring element 73. The spring element 73 may be in the form of a compression or extension spring, for example, or any other suitable mechanical element that is elastically deformable. The spring elements 73 are configured to deflect in radial and/or axial directions of the prongs 50, 52, thereby advantageously decreasing forces required to be exerted by the user during mounting and dismounting of protective shoe covers to the prongs 50, 52. Further, flexibility of the prongs 50, 52 in radial directions enables the prongs 50, 52, to generally conform to the shape of a user's shoe being inserted into the shoe cover supported by the prongs 50, 52.

Turning now to the first and second shoe cover removal mechanisms 24, 26 shown in FIGS. 1-3B, each removal mechanism 24, 26 is mounted to the deck portion 18 of the device base 12 and is configured to remove a protective shoe cover from the shoe of a user. As shown in FIG. 1, the first and second shoe cover removal mechanisms 24, 26 may be positioned at opposing ends of the shoe cover application mechanism 22, and proximate respective first and second ends 14, 16 of the base 12. It will be understood that the first and second shoe cover removal mechanisms 24, 26 may be substantially similar in construction and function.

Each shoe cover removal mechanism 24, 26 may include an elongate anchor member 70, a first gripping element 72 disposed at a first end of the anchor member 70, and a second gripping element 74 disposed at a second end of the anchor member 70. The anchor member 70 may include base plates 76 extending from the sides thereof for securing to the deck portion 18 of the device base 12. Each of the gripping elements 72, 74 includes an outwardly projecting lip 78 configured to grip a portion of a protective shoe cover applied to the shoe of a user to assist in removing the shoe cover from the shoe, as described below.

Figure 3A:
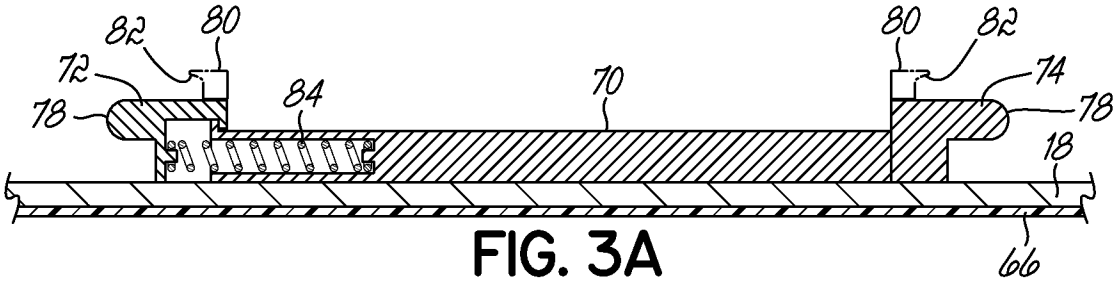
FIG. 3A is a front cross-sectional view taken along line 3-3 in FIG. 1, showing a shoe cover removal mechanism of the assistive device in a first position.
Figure 3B:
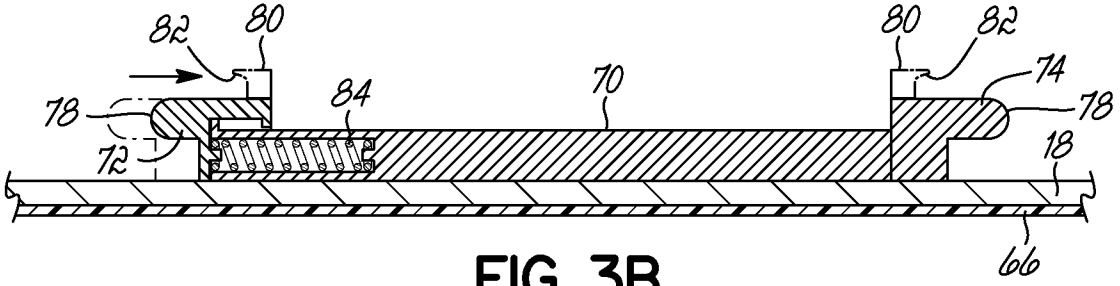
FIG. 3B is a front cross-sectional view similar to FIG. 3A, showing the shoe cover removal mechanism in a second position.

As best shown in FIGS. 2-3B, each gripping element 72, 74 may further include a retractable projecting element 80 extending from an upper portion of the gripping element 72, 74. The projecting element 80 may include an outwardly projecting lip 82 also being configured to grip a portion of a protective shoe cover applied to the shoe of a user to assist in removing the shoe cover from the shoe. Each projecting element 80 may be moveable between a deployed, extended position shown in FIGS. 2-3B, and a retracted position in which the projecting element 80 is substantially flush with an upper surface of, or otherwise recessed within, the respective gripping element 72, 74. The outwardly projecting lips 78, 82 of the gripping elements 72, 74 and the projecting elements 80 may be tapered for improving the ability to engage and grip a protective shoe cover to be removed.

Referring to FIGS. 3A and 3B, the first gripping element 72 of each shoe cover removal mechanism 24, 26 may be movably coupled to the anchor member 70 while the second gripping element 74 is rigidly coupled to the anchor member 70. In particular, the first gripping element 72 is linearly movable relative to the anchor member 70 between an extended position shown in FIG. 3A in which the removal mechanism 24, 26 has a first length and defines a first distance between the first and second gripping elements 72, 74, and a retracted position shown in FIG. 3B in which the removal mechanism 24, 26 has a second shorter length and defines a second short distance between the first and second gripping elements 72, 74. In alternative embodiments, the first and/or the second gripping elements 72, 74 may be movable relative to one another between first and second positions by employing various alternative forms of movement, such as angular or rotational movement, for example.

A biasing member, shown herein as a compression spring 84, may be provided at the coupling point between the first gripping element 72 and the anchor member 70 for biasing the first gripping element 72 into the extended position. In the exemplary arrangement shown in FIGS. 3A and 3B, the compression spring 84 is received at one end within an internal pocket in the anchor member 70, and at the opposed end within an internal pocket in the first gripping element 72. As shown in FIG. 3B, the first gripping element 72 may be forced into the retracted position relative to the anchor member 70 by compressing the compression spring 84. It will be understood that the coupling between the first gripping element 72 and the anchor member 70 as shown herein is merely exemplary, and that various alternative configurations may also be suitable.

Use of the shoe cover removal mechanisms 24, 26 for removal of protective shoe covers applied to shoes will now be described according to an exemplary embodiment of the invention. Advantageously, the shoe cover removal mechanisms 24, 26 enable quick and simple removal of protective shoe covers while the user remains in a standing position and without requiring the use of the user's hands to manipulate the shoe covers or the assistive device 10. For exemplary purposes, reference will be made to the protective shoe covers 44 shown in FIG. 4. Additionally, it will be understood each of the shoe cover removal mechanisms 24, 26 may function in a similar manner.

In one embodiment, the user may position his or her shoe so as to engage the heel end 58 of the underside of the applied shoe cover 44 with the lip 78 of the first gripping element 72. The user may then force the first gripping element 72 toward the anchor member 70 into the retracted position, followed by rolling the foot forward to engage the toe end 56 of the underside of the shoe cover with the lip 78 of the second gripping element 74. Upon releasing the force being exerted on the first gripping element 72, the compression spring 84 causes the first gripping element 72 to spring back to the expanded position, thereby stretching and securely gripping the underside of the shoe cover 44. The user may then lift his or her foot out of the shoe cover 44, while the shoe cover 44 is retained by the shoe cover removal mechanism 24, 26. The user may then position the other shoe relative to the same or the other shoe cover removal mechanism 24, 26 for removal of an applied protective shoe cover 44 from that shoe, in a manner similar to that described above. During removal of a protective shoe cover 44 from either shoe, the user may position his or her other foot on top of one of the non-slip traction pads 64 so as to safely maintain balance and stability while remaining in a standing position.

In another embodiment, the user may elect to deploy one or both of the retractable projecting elements 80 from their respective gripping elements 72, 74 of the shoe cover removable mechanism 24, 26. The user may then engage the toe end 56 and/or the heel end 58 of the underside of the applied shoe cover 44 with the either or both of the lips 82 of the extended projecting elements 80 in a manner similar to that described above in connection with the lips 78 of the gripping elements 72, 74. A force exerted by the heel of the user onto the projecting element 80 of the first gripping element 72 may function to move the first gripping element 72 into the retracted position, as described above. It will be understood that the projecting elements 80 may be used as gripping devices in combination with, or alternatively to, the lips 78 of the gripping elements 72, 74. In other words, the user may engage the underside of an applied shoe cover 44 to either of both of the lips 78, 82 of a gripping element 72, 74 and its corresponding projecting element 80 for removal of the applied shoe cover 44.

As described above, the shoe cover removal mechanisms 24, 26 and the shoe cover mounts 38, 40, 42 are operatively coupled to the base 12 of the assistive device 10. For example, these components 24, 26, 38, 40, 42 may be releasably coupled to the base 12 using various mechanical fasteners known in the art, such as screws and/or bolts. Accordingly, and advantageously, any one of the components 24, 26, 38, 40, 42 may be quickly and easily attached to and detached from the base 12 as desired, for example for maintenance or modification purposes.

While the shoe cover application mechanism 22 and shoe cover removal mechanisms 24, 26 are shown and described as mounted to a portable base 12, in alternative embodiments these shoe cover mechanisms 22, 24, 26 may be mounted to any suitable support structure or support structures. For example, the mechanisms 22, 24, 26 may be mounted to a common support structure such as a floor or a wall, or to independent support structures such one or more free standing objects supported by a floor and/or by a wall.

Referring to FIGS. 6-9, shoe cover assistive devices according to additional exemplary embodiments of the present invention are shown. Similar reference numerals refer to similar features described above.

Figure 6:
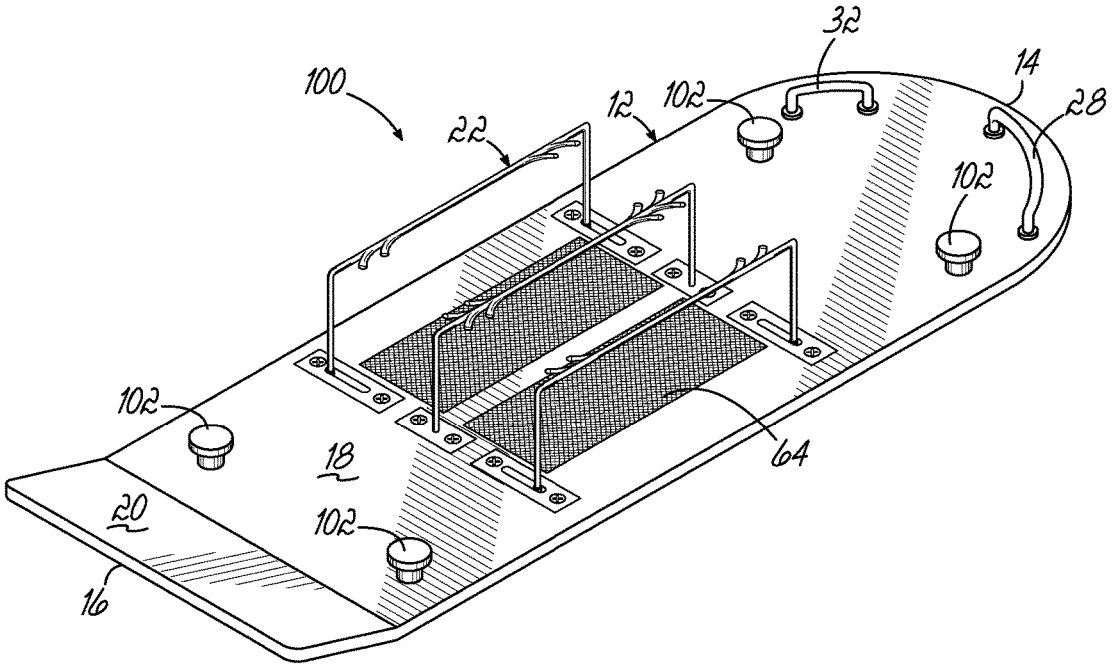
FIG. 6 is a perspective view of a shoe cover assistive device according to another exemplary embodiment.

Referring to FIG. 6, an assistive device 100 according to another embodiment may include shoe cover removal mechanisms in the form of protrusions 102 rigidly secured to and extending upwardly from the deck portion 18 of the device base 12. The first end 14 of the base 12 may include a carrying handle 28 and a mounting ring 32 for securing to a carrying strap (see, e.g., FIGS. 1 and 12).

Figure 7:
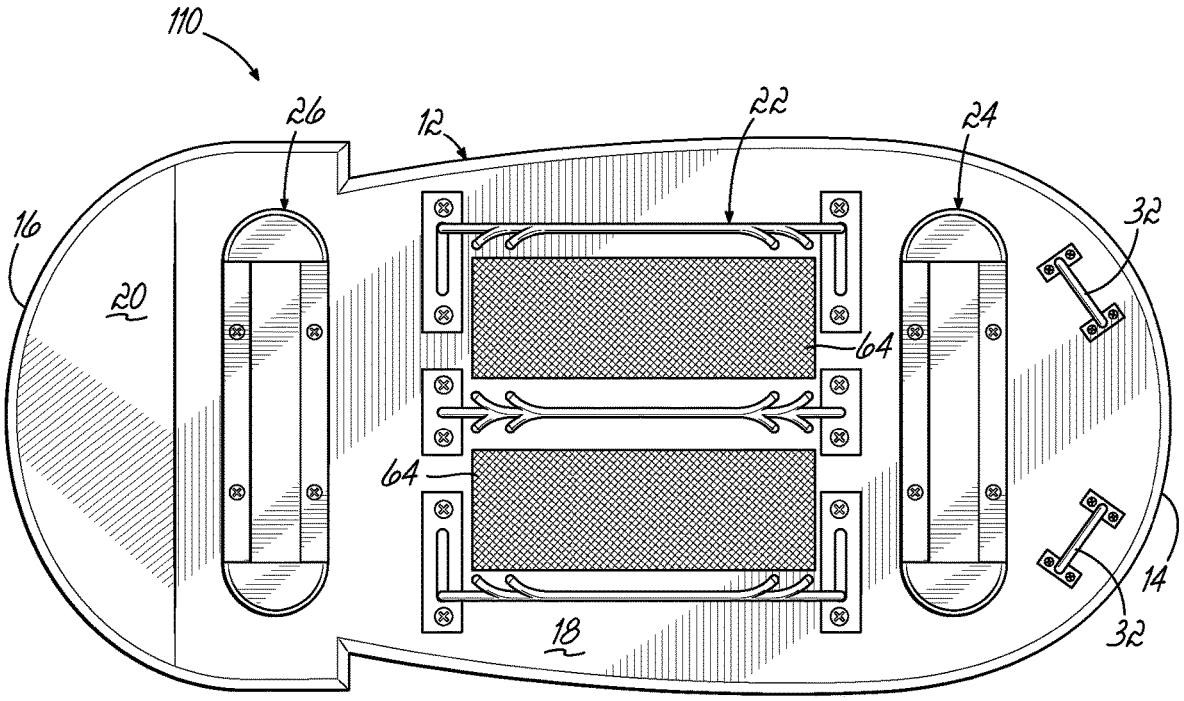
FIG. 7 is a perspective view of a shoe cover assistive device according to another exemplary embodiment.

Referring to FIG. 7, an assistive device 110 according to another embodiment may include a base 12 formed with a shape that substantially corresponds to that of a shoe print. In that regard, as described above, it will be appreciated that the exemplary assistive devices described herein may be formed with any desired shapes and sizes, for example those suitable for portability of the devices.

Figure 8:
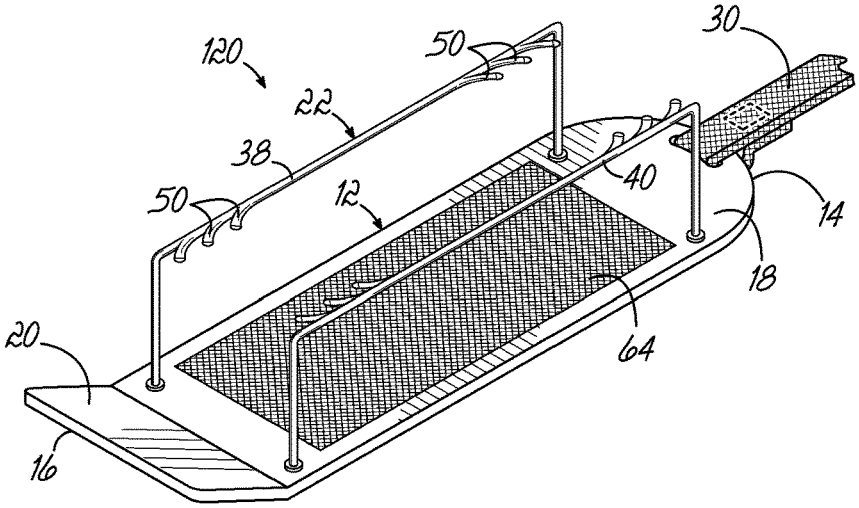
FIG. 8 is a perspective view of a shoe cover assistive device according to another exemplary embodiment.

Referring to FIG. 8, an assistive device 120 according to another embodiment is shown having a particularly compact size and shape to maximize portability of the device 120. Unlike the assistive devices described above, the assistive device 120 may include only two shoe cover side mounts 38, 40 that define a single shoe cover channel. Additionally, each side mount 38, 40 may include an additional set of inner prongs 50. In that regard, it will be appreciated that any assistive device disclosed herein may include any suitable quantity of inner and outer prongs 50, 52. While the device 120 is shown without a shoe cover removal mechanism, it will be appreciated that such a mechanism may be provided on the deck portion 18 of the device base 12. For example, the shoe cover removal mechanism may be in form of protrusions similar to protrusions 102 shown in FIG. 6.

Figure 9:
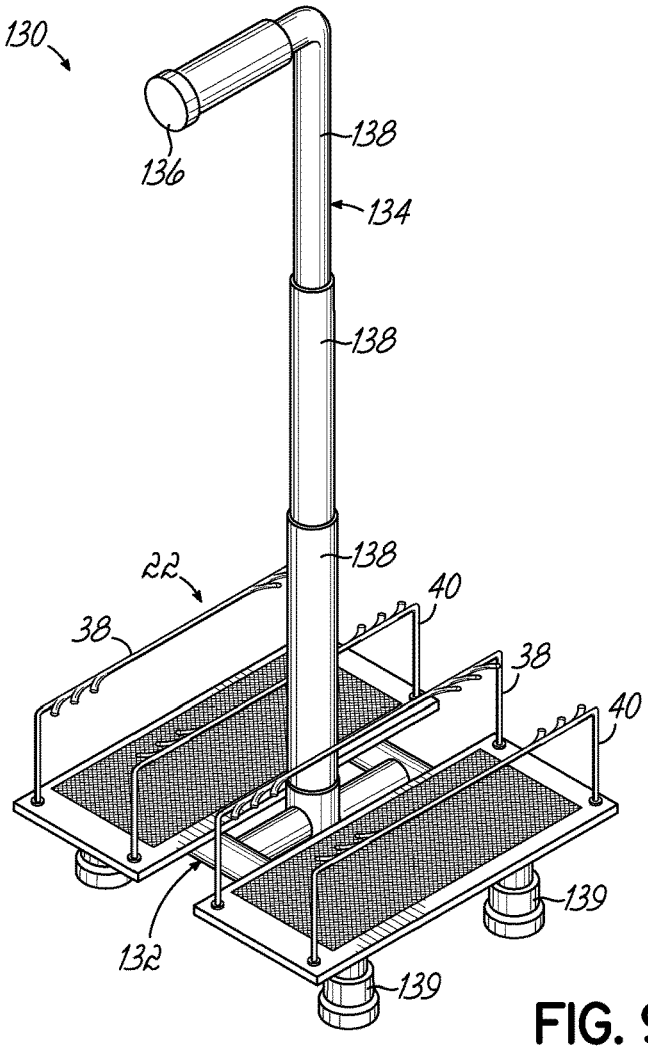
FIG. 9 is a perspective view of a shoe cover assistive device according to another exemplary embodiment.

Referring to FIG. 9, an assistive device 130 according to another embodiment includes a shoe cover application mechanism 22 having two pairs of shoe cover side mounts 38, 40, each pair defining a respective shoe cover channel and being secured to a central support structure 132 that is mountable to a support cane 134 having a handle 136. During use, a user may lean on the support cane 134, using the handle 136, while inserting a foot into a protective shoe cover mounted to either pair of the shoe cover side mounts 38, 40. The support cane 134 provides the user with increased stability during shoe cover application, thereby increasing safety and ease of shoe cover application. The support cane 134 may include a plurality of collapsible (e.g., telescoping) segments 138, which may be collapsed to reduce the size of the assistive device 130 during non-use, thereby improving portability of the device 130. The support cane 134 may also include feet 139 that elevate the shoe cover application mechanism 22 above a ground surface. The handle 136 of the support cane 134 may be easily grasped for retrieval of the assistive device 130 from the ground surface after application of the protective shoe covers. Additionally, though not shown, the assistive device 130 may include one or more shoe cover removal mechanisms, such as the removal mechanisms 24, 26, 102 described above, for example.

Figure 10:
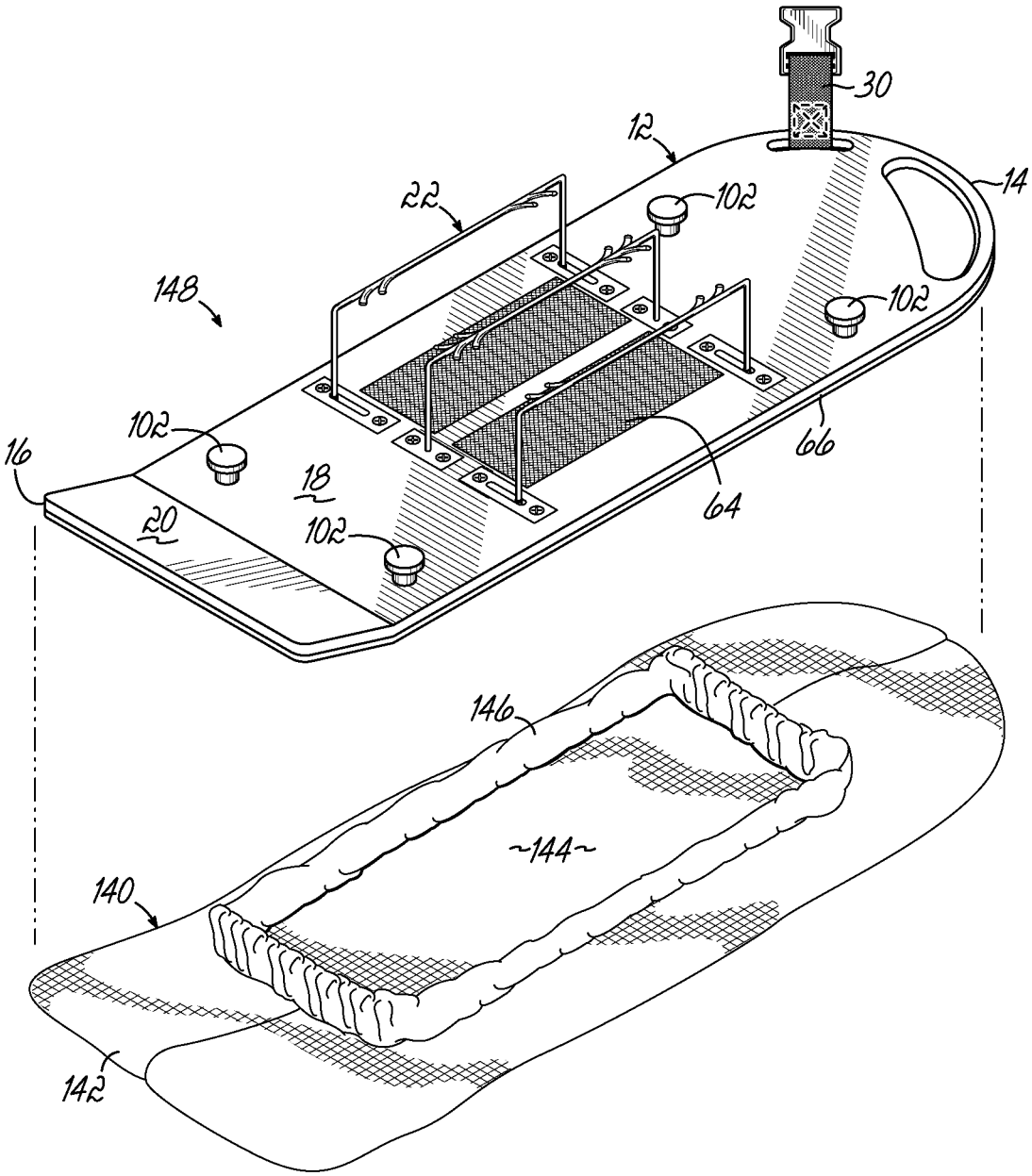
FIG. 10 is a perspective view of a protective cover for covering a bottom portion of a shoe cover assistive device, according to an exemplary.

Referring to FIG. 10, an exemplary protective device cover 140 is shown in combination with an assistive device 148 according to another exemplary embodiment similar to the assistive device 100 shown in FIG. 6. The protective device cover 140 may be sized and shaped as desired for use in combination with any of the exemplary assistive devices disclosed herein, including assistive device 10 shown in FIG. 1, as referenced below. The protective device cover 140 may be removably applied to an underside of an assistive device to protect a floor surface from contamination by the assistive device during use. The protective device cover 140 may be used in addition to a protective layer 66 provided on the bottom surface of the device base 12, shown in FIG. 2.

The protective device cover 140 shown herein includes a non-rigid body 142 defining an inner device pocket 144 for receiving the base 12 of the assistive device 10. The non-rigid body 142 includes an elastic collar 146 defining an opening to the device pocket 144, the elastic collar 146 being alterable between a contracted, relaxed state and an expanded state for receiving the device base 12 into the device pocket 144. The protective device cover 140 may be similar in construction, materials, and function to protective shoe covers known in the art. For example, the non-rigid body 142 may be formed of any suitable plastic, such as polyethylene, or non-woven fabric, such as polypropylene, or combination thereof. In that regard, the protective device cover 140 may be disposable. Alternatively, the protective device cover 140 may be formed from a durable material, such as a cotton-based material, that allows the cover 140 to be washed and reused multiple times as desired.

When the protective device cover 140 is applied to an assistive device, the elastic collar 146 and upper portion of the non-rigid body 142 extend over the outer edges of the device base 12 and overlie and conform to an upper surface of the device base 12. A main portion of the non-rigid body 142 overlies the underside of the assistive device. The protective device cover 140 may be applied to the device base 12 prior to placing the assistive device onto a ground surface, such as a floor in a customer residence, for example. The protective device cover 140 aids in mitigating contamination of the ground surface, and thus offers protective advantages in addition to those offered by the protective layer 66.

Figure 11A:
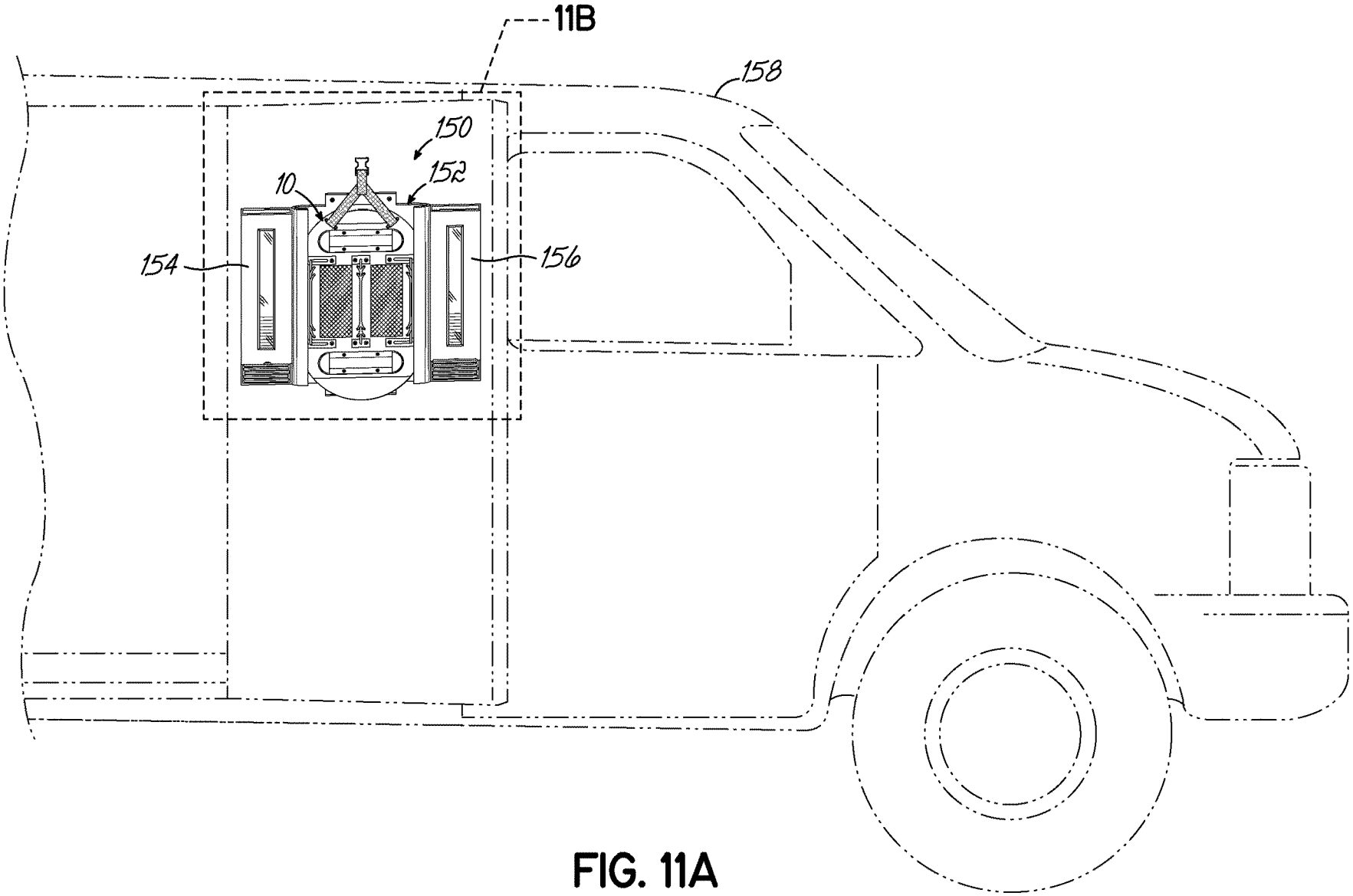
FIG. 11A is a perspective view of a system for use with protective shoe covers, according to an exemplary embodiment.
Figure 11C:
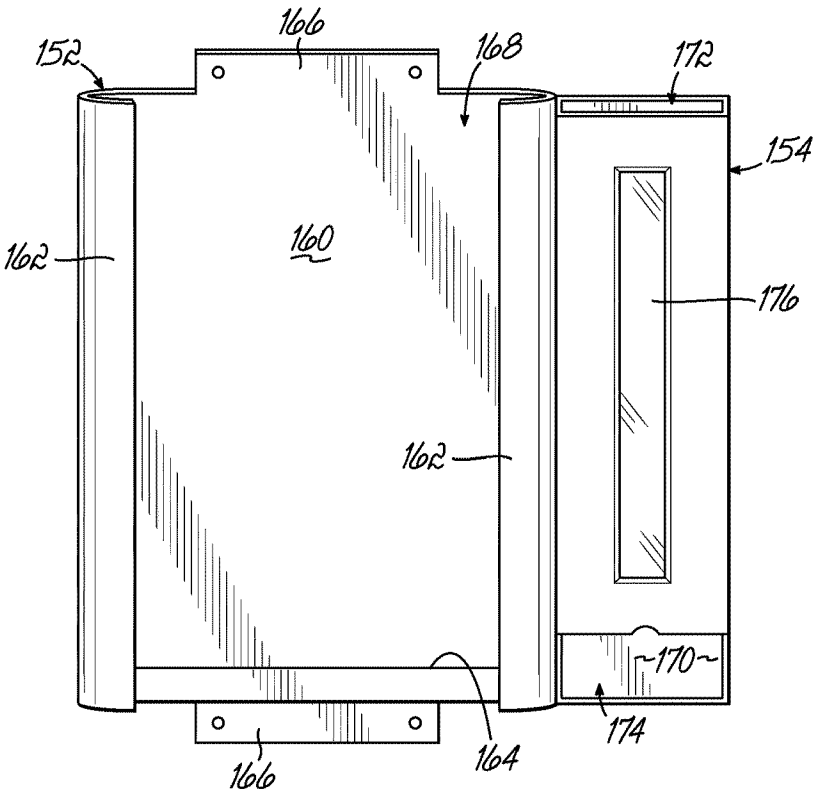
FIG. 11C is a perspective view of a holder and a protective shoe cover dispenser of the system of FIG. 11A.
Figure 11B:
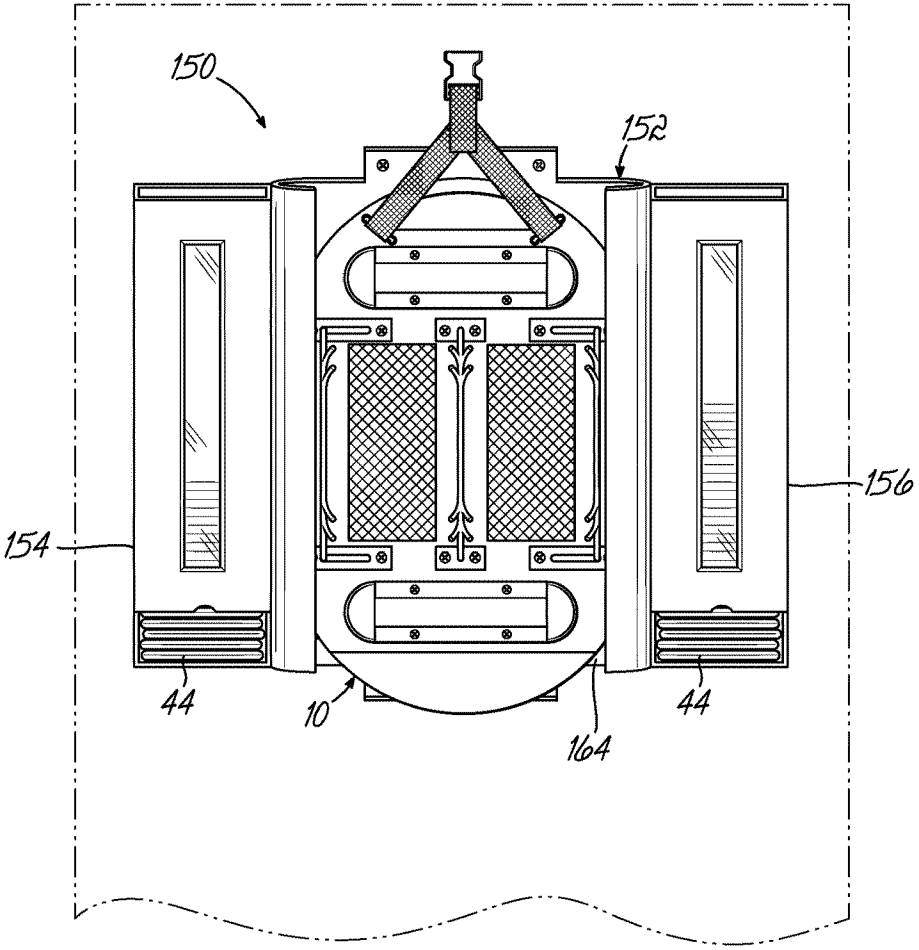
FIG. 11B is an enlarged view of the system of FIG. 11A.

Referring to FIGS. 11A-11C, an exemplary system 150 for use with protective shoe covers 44 in accordance with an exemplary embodiment of the present invention is shown. The system 150 includes a device holder 152 and first and second cover dispensers 154, 156. The device holder 152 is configured to releasably receive and retain any one of the assistive devices described herein, such as device 10, when not in use. Further, the device holder 152 is mountable to a vertical support surface such as the inner wall on the door of a service vehicle 158, as shown in FIG. 10A.

The device holder 152 includes a back wall 160 and a pair of opposed side retaining walls 162 extending outwardly from opposed lateral sides of the back wall 160, and inwardly at a front side of the device holder 152 to define a device channel into which the assistive device may be received. The side retaining walls 162 are shown herein as arcuate walls, though various alternative configurations are also possible.

As shown best in FIG. 11C, the device holder 152 may further include a support ledge 164 projecting outwardly from and substantially perpendicularly to the back wall 160, and mounting flanges 166 extending from upper and lower ends of the back wall 160. The device holder 152 may be mounted to a vertical support surface using the mounting flanges 166, as shown in FIGS. 11A and 11B.

As shown in FIGS. 11A and 11B, the assistive device 10 may be received into the device channel of the device holder 152 such that each side retaining wall 162 partially overlies a respective lateral side of the device base 12, thereby retaining the assistive device 10 within the device holder 152. The side retaining walls 162 are laterally spaced from one another so as to define a central opening 168 therebetween through which the shoe cover application mechanism 22 may project during storage. In one embodiment, the side retaining walls 162 may be formed so as to elastically clamp against the lateral sides of the device base 12. The support ledge 164 may support the assistive device at a lower end thereof, for example at the tail portion 20. In this manner, the assistive device may be securely retained by the device holder 152 during periods of non-use.

As shown best in FIG. 11B, the first and second cover dispensers 154, 156 may be secured to the lateral sides of the device holder 152, adjacent to respective retaining walls 162. Each of the cover dispensers 154, 156 includes a chamber 170 for storing a respective plurality of protective covers 44, an upper opening 172 through which the protective covers 44 may be loaded into the chamber 170, and a lower opening 174 through which the protective covers 44 may be dispensed from the chamber 170. While the cover dispensers 154, 156 are shown containing protective shoe covers 44, it will be appreciated that any selected protective shoe covers, such as shoe covers 200, 220, 230 described below, may also be used. Additionally, in one embodiment one of the cover dispensers 154, 156 may be filled with a supply of protective shoe covers 44, and the other of the cover dispensers 154, 156 may be filled with a supply of protective devices covers, such as the device cover 140 described above. Each cover dispenser 154, 156 may further include a window 176 that provides a visual indication to the user of the quantity of covers 44, 140 remaining within the chamber 170.

While the cover dispensers 154, 156 are shown herein as being substantially elongate and rectangular in shape, it will be appreciated that the cover dispensers 154, 156 may be formed with various alternative shapes, and may be used in combination with the device holder 152 in any suitable manner. Additionally, more or fewer cover dispensers 154, 156 may be provided. For example, the system 150 may include only a single cover dispenser 154, as shown in FIG. 11C, which may be filled with a supply of protective shoe covers 44, for example.

Referring to FIGS. 12-15, an exemplary method of using the system 150 will now be described in connection with shoe cover assistive device 10. The exemplary method is described in the context of a service professional 180 performing a service call at the residence of a customer, though it will be understood that the system 150 may be utilized similarly in various alternative applications.

First, the assistive device 10 is removed from the device holder 152 and the shoe cover mounts 38, 40, 42 are preloaded with a pair of protective shoe covers 44 obtained from the first cover dispenser 154. The protective shoe covers 44 may be loaded onto the mounts 38, 40, 42 in the manner generally described above in connection with FIG. 4. Additionally, the device base 12 may be fitted with a protective device cover 140 obtained from the second cover dispenser 156. The assistive device 10 may then be fitted onto the back and shoulders of the service professional 180, using the support strap 30, as shown in FIG. 12, for carrying into the customer residence or other desired location.

Figure 13:
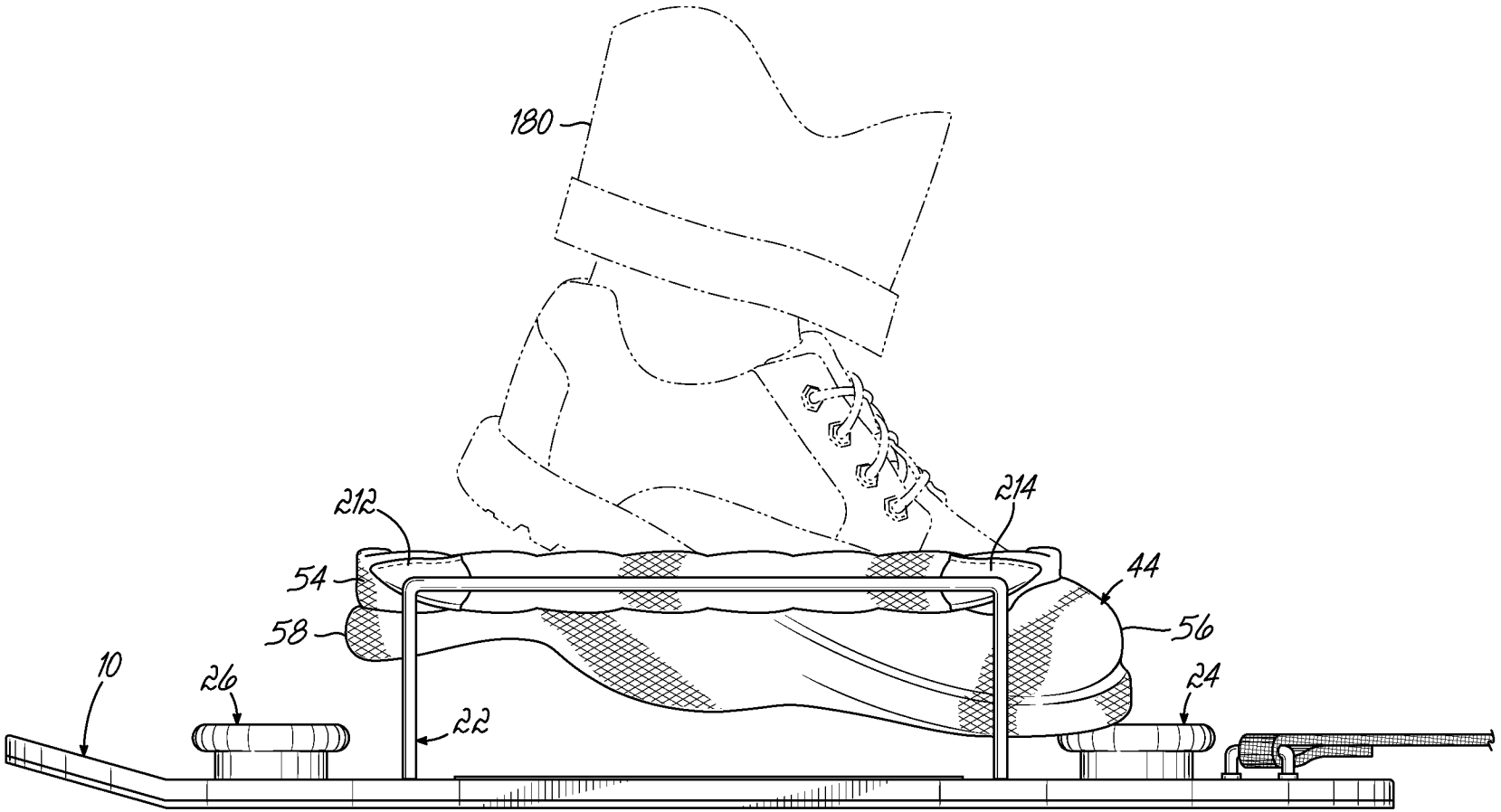
FIG. 13 is a side view showing the shoe cover application mechanism of the assistive device of FIG. 1 in use according to an exemplary embodiment.

As shown in FIG. 13, upon reaching the front door of the customer residence, the service professional 180 may greet the customer, place the assistive device 10 onto the ground surface, and apply the preloaded shoe covers 44 onto his or her shoes in the presence of the customer, using the shoe cover application methods as generally described above. As shown, the shoe cover 44 may include a pair of heel end side flaps 212 and a pair of toe end side flaps 214, as described below in connection with FIG. 16, to facilitate removal of the shoe cover 44 using the shoe cover application mechanism 22. Having directly viewed the application of the protective fresh protective shoe covers 44, the customer is thus provided with a level of assurance that the shoe covers 44 are uncontaminated and sanitary.

Figure 14:
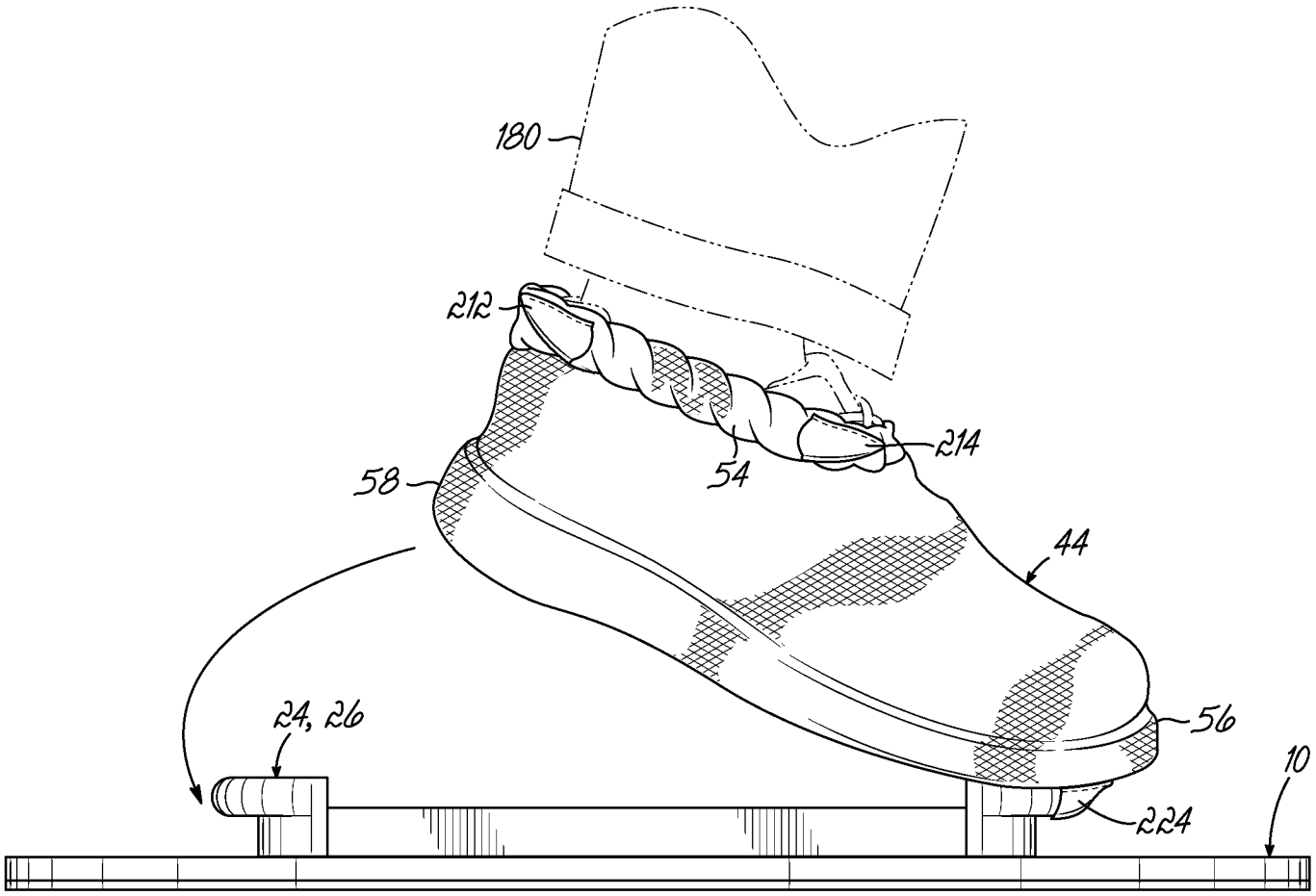
FIG. 14 is a side view showing a shoe cover removal mechanism of the assistive device of FIG. 1 in use according to an exemplary embodiment.

As shown in FIG. 14, after performance of the service work has been completed within the customer residence, the service professional 180 may use one or both of the shoe cover removal mechanisms 24, 26 on the assistive device 10 to remove the applied shoe covers 44 from his or her feet. The service professional 180 may remain in a standing position during shoe cover removal, without using his or her hands to aid the process. As shown, the shoe cover 44 may include a toe end lower flap 224 and optionally also a heel end lower flap (not shown), as described below in connection with FIG. 17, to facilitate removal of the shoe cover 44 using a shoe cover removal mechanism 24, 26. The shoe cover removal mechanism 24, 26 may be operated generally as described above in connection with FIGS. 2-3B.

Figure 15:
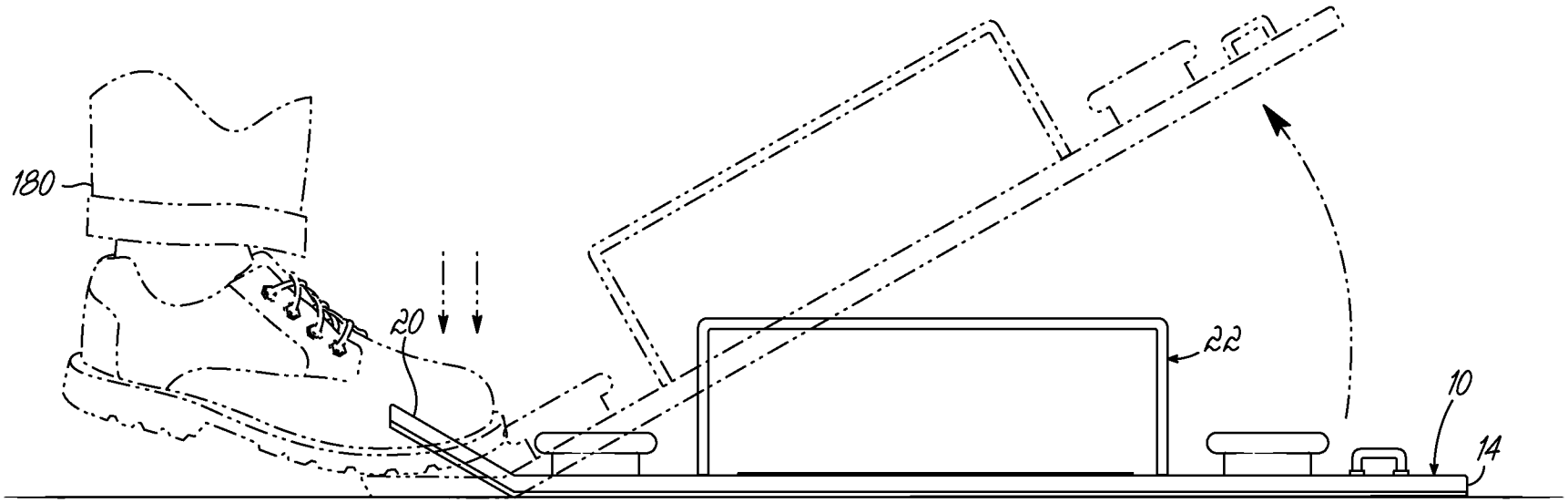
FIG. 15 is a side view showing an angled tail portion of the assistive device of FIG. 1 in use according to an exemplary embodiment.

As shown in FIG. 15, following shoe cover removal, the service professional 180 may then retrieve the assistive device 10 from the ground surface, without bending over, by stepping on the angled tail portion 20 to elevate the first end 14 of the device base 12. In this manner, the service professional 180 may safely and easily grasp and lift the first end 14 of the assistive device 10 without bending fully over.

Figure 16:
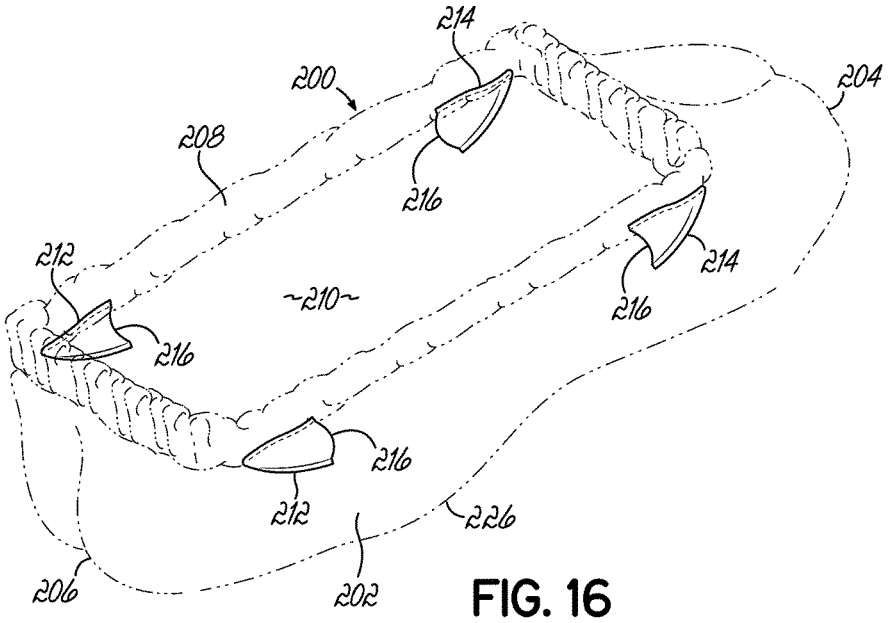
FIG. 16 is a perspective top view of a protective shoe cover according to an exemplary embodiment.

Referring to FIG. 16, a protective shoe cover 200 in accordance with an exemplary embodiment of the present invention is shown. The protective shoe cover 200 includes a non-rigid body 202 having a toe end 204 and an opposed heel end 206. An elastic collar 208 is formed at an upper end of the non-rigid body 202 and defines an opening to an internal shoe pocket 210 defined by the non-rigid body 202. The shoe pocket 210 is adapted to receive a shoe of a user. The elastic collar 208 is alterable between a stretched, expanded state as generally shown, for receiving a shoe into the shoe pocket 210, and a contracted state in which the elastic collar 208 substantially conforms to an outer surface of a shoe and/or foot positioned within the shoe pocket 210.

In various embodiments, the non-rigid body 202 may be formed of any suitable material that lends the shoe cover 200 to being disposable and replaceable for minimal monetary cost. For example, the non-rigid body 202 may be formed of any suitable thermoplastic, such as polyethylene, or non-woven fabric, such as polypropylene, or any combination thereof. In other embodiments, the non-rigid body 202 may be formed of any suitable material that provides the shoe cover 200 with increased durability so as to be washable and reusable. For example, the non-rigid body 202 may be formed of any suitable cotton-based material.

The protective shoe cover 200 includes a plurality of device engagement elements configured to engage a shoe cover application mechanism and/or a shoe cover removal mechanism of a shoe cover assistive device, such as device 10. More specifically, in the illustrated embodiment, the shoe cover 200 includes side flaps 212, 214 disposed on an upper side portion of the non-rigid body 202 proximate the elastic collar 208, and which facilitate shoe cover application. In the embodiment shown in FIG. 16, the shoe cover 200 includes a pair of heel end side flaps 212 disposed on opposed lateral sides of the non-rigid body 202 proximate the heel end 206 (e.g., heel-left and heel-right positions), and a pair of toe end side flaps 214 disposed on opposed lateral sides of the non-rigid body 202 proximate the toe end 204 (e.g., toe-left and toe-right positions). Each of the side flaps 212, 214 includes an opening 216 sized to releasably receive a prong 50, 52 extending from one of the shoe cover mounts 38, 40, 42 of the assistive device 10, for example. The openings 216 of the heel end side flaps 212 face toward the openings 216 of the toe end side flaps 214. The side flaps 212, 214 may be generally triangular in shape, or may be formed with any other suitable shape.

The protective shoe cover 200 may be mounted to a pair of shoe cover mounts 38, 40, 42 such that each of the side flaps 212, 214 receives a respective prong 50, 52 at the toe-left, toe-right, heel-left, and heel-right positions, thereby maintaining the elastic collar 208 in the expanded state so that the shoe of a user may be received within the shoe pocket 210 for shoe cover application, described above. While the elastic collar 208 itself may be mounted to the prongs 50, 52 of the shoe cover mounts 38, 40, 42, as shown in FIG. 4, the side flaps 212, 214 advantageously provide a designated mechanism for mounting the shoe cover 200 in an easy and secure manner.

Figure 17:
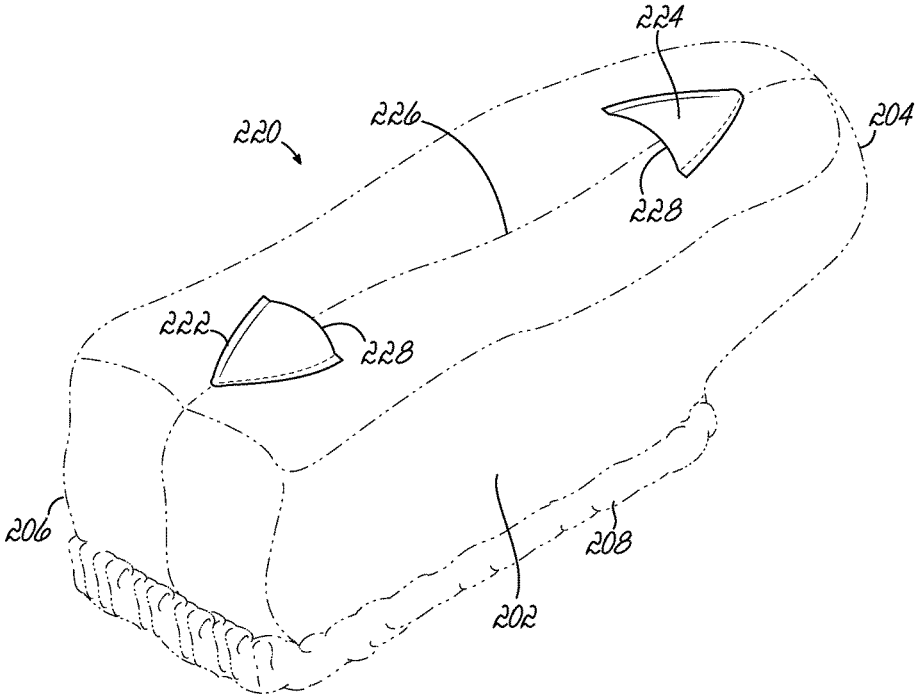
FIG. 17 is a perspective bottom view of a protective shoe cover according to another exemplary embodiment.

Referring to FIG. 17, a protective shoe cover 220 in accordance with another exemplary embodiment of the present invention is shown. Similar reference numerals refer to similar features described above in connection with the shoe cover 200 of FIG. 16. The protective shoe cover 220 may include one or more lower flaps 222, 224 on an underside 226 of the non-rigid body 202 for facilitating shoe cover removal. For example, a heel end lower flap 222 may be provided proximate the heel end 206 of the non-rigid body 202, and a toe end lower flap 224 may be provided proximate the toe end 204 of the non-rigid body 202. Each of the lower flaps 222, 224 has an opening 228 that face one another. The lower flaps 222, 224 may be generally triangular in shape, or may be formed with any other suitable shape.

The protective shoe cover 220, applied to the shoe of a user, may be positioned relative to a shoe cover removal mechanism of any one of the assistive devices described herein, and facilitate the ability of assistive device to securely retain the shoe cover 220 while the user removes his or her shoe from the shoe cover 220. For example, the openings 216 of the lower flaps 222, 224 may be sized, shaped, and spaced relative to one another to releasably receive the first and second gripping elements 72, 74 and/or the first and second projecting elements 80 of the shoe cover removal mechanisms 24, 26 shown in FIGS. 1-3B.

While the side flaps 212, 214 and lower flaps 222, 224 are shown herein in a certain quantity, shape, and arrangement, it will be appreciated that various alternative quantities, shapes, and arrangements of side flaps and lower flaps may be provided. Additionally, though not shown, a protective shoe cover may be provided that includes side flaps 212, 214 and lower flaps 222, 224.

Figure 18:
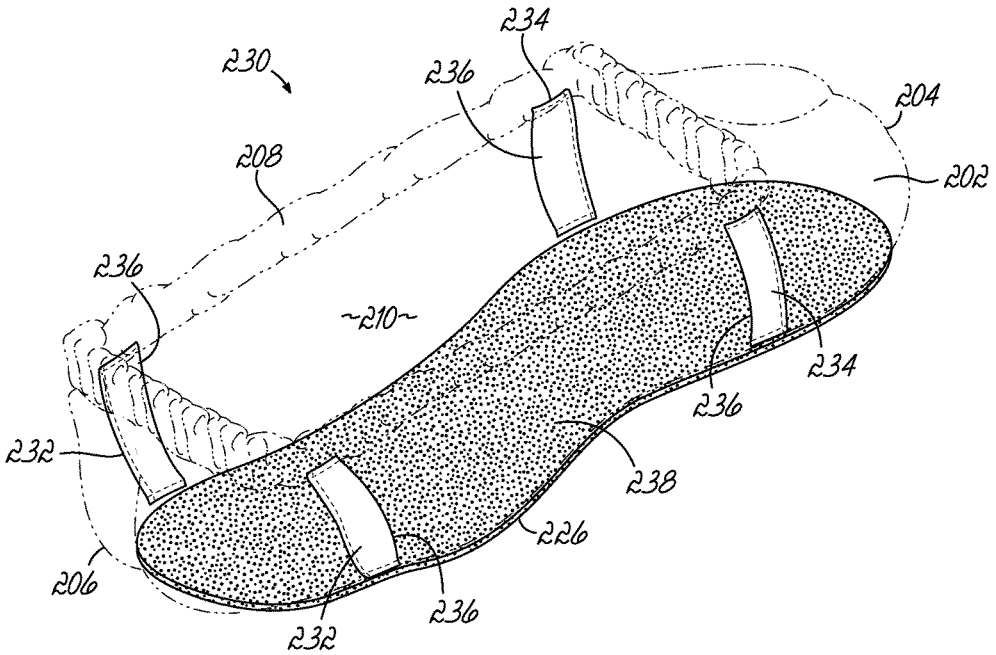
FIG. 18 is a perspective top view of a protective shoe cover according to another exemplary embodiment.

Referring to FIG. 18, a protective shoe cover 230 in accordance with another exemplary embodiment of the present invention is shown, for which similar reference numerals refer to similar features described above in connection with shoe covers 200, 220 of FIGS. 16 and 17. The shoe cover 230 includes a plurality of elongate side flaps 232, 234 formed on side portion of the non-rigid body 202 and extending generally vertically between the elastic collar 208 and the shoe cover underside 226. More particularly, a pair of heel end side flaps 232 are disposed on opposed lateral sides of the non-rigid body 202 proximate the heel end 206 (e.g., heel-left and heel-right positions), and a pair of toe end side flaps 234 are disposed on opposed lateral sides of the non-rigid body 202 proximate the toe end 204 (e.g., toe-left and toe-right positions). In an alternative embodiment, not shown, the protective shoe cover 230 may further include additional flaps that assist in removal of the shoe covers from the shoes of a user, such as lower flaps 222, 224 as shown in FIG. 17, for example.

Each of the elongate side flaps 232, 234 includes an elongate opening 236 for releasably receiving a prong 50, 52 extending from one of the shoe cover mounts 38, 40, 42 of the assistive device 10, for example. The openings 216 of the heel end side flaps 232 face toward the openings 236 of the toe end side flaps 234. The side flaps 232, 234 may be generally rectangular in shape, for example. Advantageously, the elongate construction of the side flaps 232, 234 facilitates alignment with and mounting of the shoe cover 230 to mounting elements of a shoe cover application mechanism, such as prongs 50, 52 of shoe cover application mechanism 22, for example.

The underside 226 of the protective shoe cover 230 includes a polymeric layer 238 suitable for use in various indoor and/or outdoor applications. For example, in one embodiment the polymeric layer 238 may be a rubber-based material that provides a non-slip surface suitable for use on smooth, hard ground surfaces. In other embodiments, the polymeric layer 238 may comprise various other materials suitable to enhance a resilience and/or rigidity of the underside 226 so as to render the protective shoe cover 230 suitable for use on outdoor ground surfaces. The polymeric layer 238 may be applied as a coating via a spray or dipping process, or otherwise permanently adhered to the underside 226. In other embodiments, various portions of the non-rigid body 202 may be provided with a polymeric layer for enhanced resilience, rigidity, or other performance characteristics as desired.

Similar to the non-rigid body 202 of protective shoe cover 200 described above, the non-rigid body 202 of protective shoe covers 220, 230 may be constructed of any desired material so as to render the shoe cover 220, 230 economically disposable and replaceable, or washable and reusable. Additionally, it will be appreciated that any of the exemplary protective shoe covers 200, 220, 230 may be used in combination with system 150 described above.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope of the general inventive concept.

What is claimed is:

1. An assistive device for applying a protective shoe cover to, and removing a protective shoe cover from, a shoe of a user, the assistive device comprising:

a base comprising a substrate;

a shoe cover application mechanism supported by the base so as not to be movable relative to the base once secured thereto during application of a protective shoe cover to a shoe of a user, wherein the shoe cover application mechanism includes first and second shoe cover mounts spaced apart from each other to define a shoe cover channel therebetween, with the first and second shoe cover mounts each having respective shoe cover retainers projecting from the first and second shoe cover mounts configured to directly engage the protective shoe cover located in the shoe cover channel to releasably receive and retain the protective shoe cover in an expanded state for applying the expanded protective shoe cover to a shoe such that the entire shoe cover application mechanism does not move relative to the base to releasably receive and retain the protective shoe cover in the expanded state for applying the expanded protective shoe cover to a shoe and during applying the expanded protective shoe cover to the shoe; and a shoe cover removal mechanism supported by the base and configured to releasably grip a portion of a protective shoe cover fitted on a shoe for removing the protective shoe cover from the shoe.

2. The assistive device of claim 1, wherein the shoe cover application mechanism further includes a third shoe cover mount supported by the base and positioned between the first and second shoe cover mounts, the third shoe cover mount configured to releasably retain a side of a protective shoe cover, wherein the third shoe cover mount cooperates with the first shoe cover mount to support a first protective shoe cover in an expanded state, and the third shoe cover mount cooperates with the second shoe cover mount to support a second protective shoe cover in an expanded state.

3. The assistive device of claim 2, wherein the shoe cover application mechanism further includes fourth and fifth shoe cover mounts supported by the base and configured to releasably retain a side of a protective shoe cover, the fourth shoe cover mount positioned adjacent to the first shoe cover mount and configured to cooperate therewith for supporting a third protective shoe cover in an expanded state, and the fifth shoe cover mount positioned adjacent to the second shoe cover mount and configured to cooperate therewith for supporting a fourth protective shoe cover in an expanded state.

4. The assistive device of claim 2, wherein each of the first and second shoe cover mounts includes a plurality of prongs extending outwardly therefrom, the prongs of each shoe cover mount configured to releasably engage a side of a protective shoe cover to assist in supporting the protective shoe cover in an expanded state.

5. The assistive device of claim 4, wherein at least one of the prongs on each of the first and second shoe cover mounts terminates in a spring element.

6. The assistive device of claim 1, wherein the shoe cover removal mechanism includes a first gripping element configured to grip a first portion of a protective shoe cover to be removed from a shoe, and a second gripping element configured to grip a second portion of the protective shoe cover to be removed.

7. The assistive device of claim 6, wherein the first gripping element is movable relative to the second gripping element between a first position so as to define a first distance between the first and second gripping elements, and a second position so as to define a shorter second distance between the first and second gripping elements.

8. The assistive device of claim 7, wherein the first gripping element is spring biased toward the first position.

9. The assistive device of claim 1, further comprising: a second shoe cover removal mechanism coupled to the base and configured to grip a portion of a protective shoe cover fitted on a shoe for removing the protective shoe cover from the shoe.

10. The assistive device of claim 1, wherein the base includes a deck portion to which the shoe cover application mechanism and the shoe cover removal mechanism are coupled, and a tail portion extending angularly upward from the deck portion.

11. The assistive device of claim 1, in combination with a protective device cover including a non-rigid body defining an inner pocket configured to receive the base of the assistive device.

12. The combination of claim 11, wherein the protective device cover further includes an elastic portion formed at an upper end of the non-rigid body and defining an opening to the inner pocket.

13. The assistive device of claim 2, wherein at least one of the first or second shoe cover mounts is slideably coupled to the base with adjustable base plates so that a distance between the at least one of the first and second shoe cover mounts and the third shoe cover mount can be adjusted.

* * * * *